US009984639B2

(12) United States Patent
Yin et al.

(10) Patent No.: US 9,984,639 B2
(45) Date of Patent: May 29, 2018

(54) ADAPTIVE SPATIAL OFFSET CANCELLATION OF SOURCE DRIVER

(71) Applicant: Parade Technologies, Ltd., Grand Cayman (KY)

(72) Inventors: You-Ben Yin, Hsinchu (TW); Yong-Nien Rao, Hsinchu (TW); Hua Qin, Shanghai (CN); Chia-Hsien Lin, Yilan County (TW)

(73) Assignee: PARADE TECHNOLOGIES, LTD., George Town, Grand Cayman (KY)

( * ) Notice: Subject to any disclaimer, the term of this patent is extended or adjusted under 35 U.S.C. 154(b) by 6 days.

(21) Appl. No.: 15/164,797

(22) Filed: May 25, 2016

(65) Prior Publication Data

US 2017/0345383 A1 Nov. 30, 2017

(51) Int. Cl.
*G09G 3/36* (2006.01)

(52) U.S. Cl.
CPC ... *G09G 3/3648* (2013.01); *G09G 2300/0404* (2013.01); *G09G 2310/08* (2013.01)

(58) Field of Classification Search
CPC ..... G09G 3/3648; G09G 2300/0404; G09G 2310/08
USPC ..... 345/691
See application file for complete search history.

(56) References Cited

U.S. PATENT DOCUMENTS 6,870,524 B2 * 3/2005 Katsutani ..... H03F 3/45775 345/100
7,990,401 B2 8/2011 Li et al.
8,289,490 B2 10/2012 Jang et al.
8,736,637 B2 5/2014 Rao
2006/0017680 A1 * 1/2006 Chen ..... G09G 3/3688 345/96
2008/0183098 A1 * 7/2008 Denison ..... A61B 5/0002 600/547
2009/0109198 A1 * 4/2009 Kim ..... G09G 3/006 345/204
2014/0218272 A1 8/2014 Kikuchi et al.

OTHER PUBLICATIONS

PCT International Search Report and Written Opinion, PCT Application No. PCT/US2017/026471, dated Jun. 27, 2017, 15 pages.

* cited by examiner

*Primary Examiner* — Stephen G Sherman
(74) *Attorney, Agent, or Firm* — Morgan, Lewis & Bockius LLP

(57) ABSTRACT

A display panel subsystem adaptively employs one of three types of input offset voltage cancellation modes based on an analysis of gray level values of sub-pixels for each row un a frame of image data. The system selects a candidate row within a selected group of rows and applies a first chopper mode to each sub-pixel in the candidate row. Under a row-based mode, the system applies a second chopper mode to each sub-pixel included in a row having gray level values matching the candidate row. Under a per-column row-based mode, the system applies the row-based mode on a per-column basis. Under a sub-pixel-wise mode, for each column, the system changes a chopper mode applied to a sub-pixel in a subsequent row relative to the last state of the chopper mode in a row having the same gray level value as a corresponding sub-pixel in the subsequent row.

20 Claims, 15 Drawing Sheets

ADAPTIVE SPATIAL OFFSET CANCELLATION OF SOURCE DRIVER

BACKGROUND

1. Field of Art

This application relates to a source driver circuit for a display panel, and in particular a circuit for adaptively performing offset cancellation of output buffers included in the source driver.

2. Description of the Related Art

A source driver (also referred to as a column driver) converts digital image data into analog signals for driving data lines of a display panel. The source driver includes multiple output buffers (e.g., approximately one thousand) in which each output buffer sets the voltage applied to pixels in a given column of the display panel. An output buffer may exhibit an input offset voltage (Vos), which may be compensated for by the output buffer. However, conventional output buffer offset voltage cancellation techniques provide limited effectiveness under variations of display data conditions.

BRIEF DESCRIPTION OF DRAWINGS

The disclosed embodiments have other advantages and features which will be more readily apparent from the detailed description, the appended claims, and the accompanying figures (or drawings). A brief introduction of the figures is below.

DETAILED DESCRIPTION

The Figures (FIGS.) and the following description relate to embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Overview-Display Panel Subsystem

Figure 1:
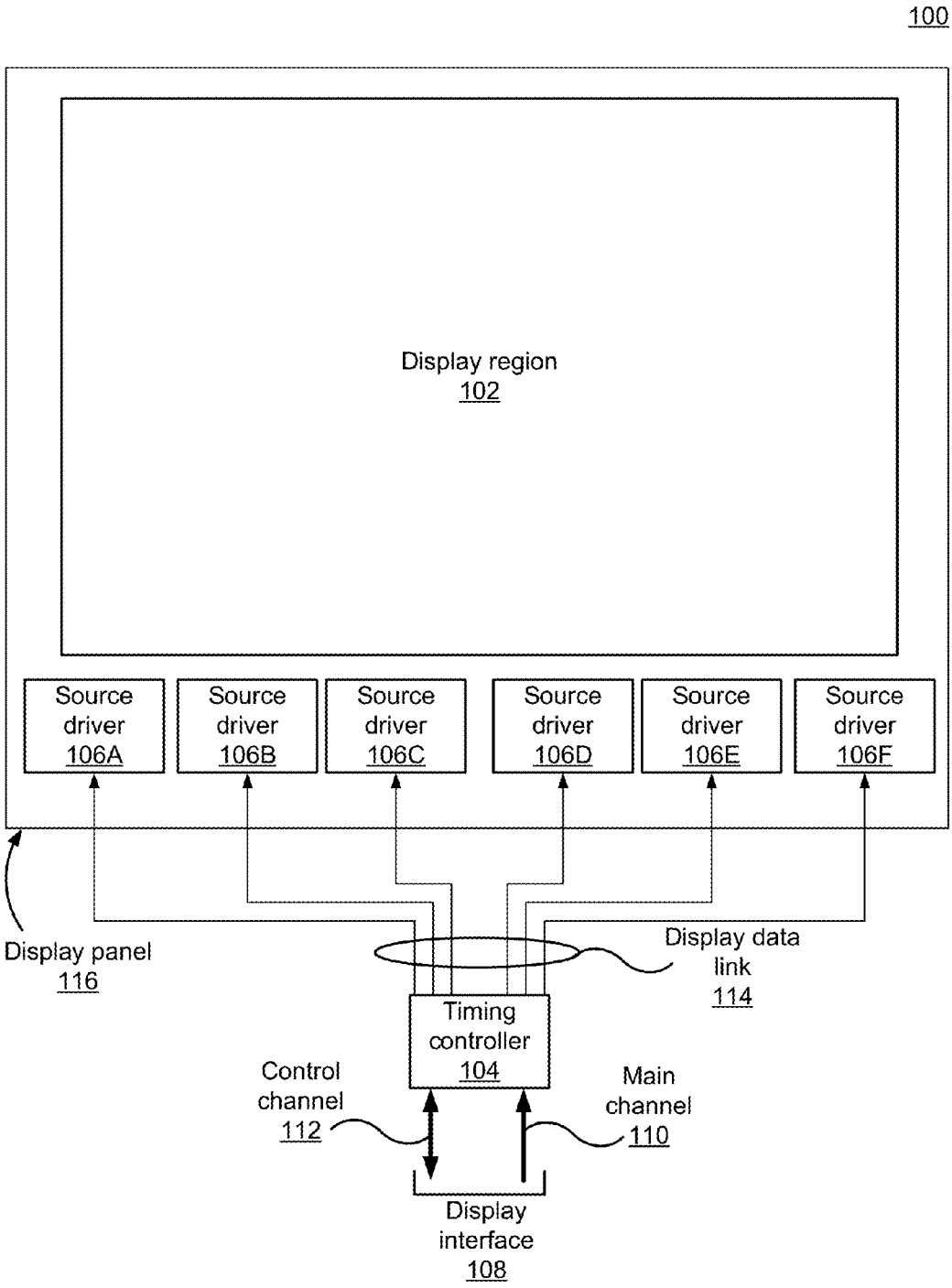
FIG. 1 is a block diagram illustrating a display panel subsystem including a timing controller and source drivers, in accordance with one embodiment.

FIG. 1 illustrates a display panel subsystem 100 including a display panel 116, a display region 102, timing controller (TCON) 104, and source drivers 106. In one implementation, the display panel 116 includes one or more display regions 102 and one or more source drivers 106 coupled to the one or more display regions 102 to supply data signals to the pixels included in each column of the one or more display regions 102. In one embodiment, the display region 102 is a liquid crystal display (LCD), such as a thin film transistor (TFT) LCD. The display region 102 uses a TFT or other active device type to control the operation of each pixel by regulating light passing a light source (e.g., fluorescent lamp or light emitting diode (LED)) through the respective pixel. In one example, a pixel comprises sub-pixels, each sub-pixel associated with a different color (e.g., red, green, or blue). Each sub pixel includes a storage element, such as a capacitor, to store energy delivered by the voltage signals generated by an output buffer included in a source driver 106. Energy stored in the storage device produces a voltage used to regulate the operation of the corresponding active device for each sub-pixel. In many cases, each column of the display region 102 includes hundred pixels, each with multiple sub-pixels, forming a highly capacitive load.

Each sub-pixel included in the display region 102 is connected by a grid of row and column lines (not shown). The grid of row and column lines connects perpendicularly to an active device, such as a transistor, to control the operation of the display segment at the intersection of column and row lines. In one implementation, each sub-pixel is connected to the grid by one row line and one column line. Each row line is connected to a row driver circuit (not shown). The row driver circuit (also referred to as gate driver) generates signals to selectively address each row of sub-pixels. In operation, a gate driver applies a specified voltage to the gate of the active devices included in a selected row to turn on the active devices within the selected row of sub-pixels. While, a source driver 106 is coupled to each column line to control the operation of a specific sub-pixel within the row of sub-pixels.

Each source driver 106 receives multi-bit digital image data from the timing controller 104 via a signal line included in the display data link 114, converts the image data to analog voltage levels, and provides the analog voltage levels to a specified column of sub-pixels using the column line. The number of data bits used to represent an image data value determines the number of light levels that a particular sub-pixel may produce. For example, 10-bit image data may be converted into 1024 analog signal levels generated by the output buffers in each source driver. A measure of the intensity of the light emitted by each sub-pixel may be represented as a gray level. In one implementation, the gray level is represented by a multi-bit value ranging from 0, corresponding to black, to a maximum value (e.g., 1023 for a 10-bit gray level value). A 10-bit gray level value allows each sub-pixel to produce 1024 different light intensities.

The transmission path formed by the output of each source driver 106 to the input of each sub-pixel in a specific column of sub-pixels is referred to herein as an output channel or channel. A source driver 106 includes multiple output buffers, where each output buffer operates to rapidly charge the column line capacitance of the corresponding channel. In operation, the DC power supplied to each output buffer and the dynamic power expended to charge and discharge these highly capacitive output channels dominate the overall power consumption of the display panel subsystem 100. Further description of the output buffers is provided with reference to FIG. 4.

The display panel subsystem 100 also includes a timing controller 104 that receives display data from one source over display interface 108 and generates control and data signals to selectively apply image data included in the display data to sub-pixels included in the display region 102. Further description of the control signals is described with reference to the timing controller 104 described in FIG. 2. Example display data sources include integrated circuits included within the same system that includes the display panel subsystem 100. Additional example display data sources include external computing system, such as a set-top box, digital video disk player, or other computing device that generates video signals suitable to be received by the timing controller 104 over the display interface 108. In one embodiment, the display interface 108 includes a main channel 110 and a control channel 112. The main channel 110 carries image data, such as video data, for display on the display region 102. The control channel 112 enables bi-directional communication between each of the source drivers 106 and the timing controller 104. The control channel 112 carries control information used by the display data. Example control information includes training information, and test and debug information. The control channel 112 also carries status information, including data error rate as measured at one or a combination of the source driver 106 and the timing controller 104.

In one embodiment, the display interface 108 supports signaling protocols to support a variety of digital display data formats, e.g., display port, and HDMI (High-Definition Multimedia Interface).

Figure 2:
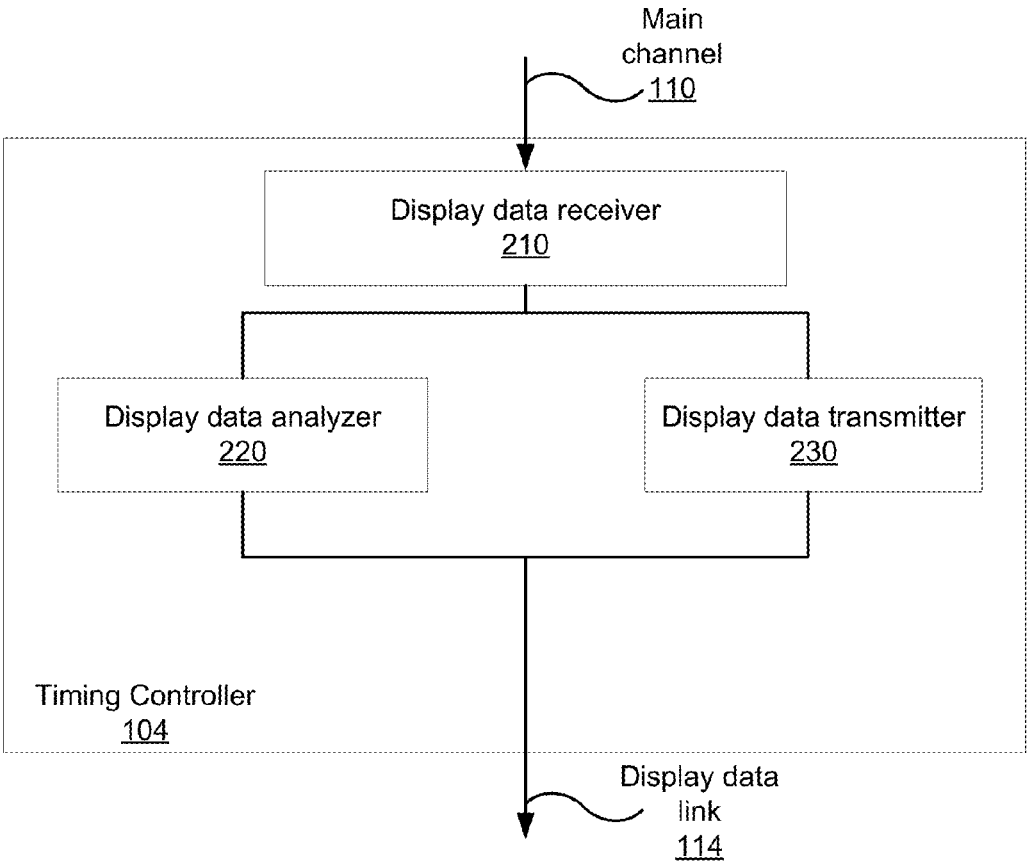
FIG. 2 illustrates a detailed view of the timing controller of the display panel subsystem, in accordance with one embodiment.

FIG. 2 illustrates a detailed view of the timing controller 104 of the display panel subsystem 100, in accordance with one embodiment. The timing controller 104 includes an image buffer (not shown), a display data receiver 210, a display data analyzer 220, and a display data transmitter 230. The image buffer stores the display data received from the source via the display interface 108. Example image buffers include a specified portion memory device or embedded memory. The size of the image buffer may be configured by a user, programmed during manufacturing, or otherwise selected based on the system requirements for the display panel subsystem 100. In some embodiments, the image buffer may be included in the display data receiver 210.

The display data receiver 210 receives a portion of the display data via the main channel 110 from the display interface 108 and generates control and data signals to provide the display panel drive circuitry for displaying the image data included in the display data on the display region 102. The received display data includes image data representing the image to be displayed on the display region 102, and control data used by the drive circuitry of the display panel subsystem 100 to properly display the image data on the display region 102.

The control data includes global timing signals including vertical timing signals, such as vertical sync (VSYNC) or frame pulse (FP), and horizontal timing signals, such as horizontal sync (HSYNC) or line pulse (LP). The global timing signals also include display refresh signals for refreshing a displayed image, clock signals for operating gate drivers, and clock signals and latch enable for operating source drivers 106. Using the global timing signals, the display data receiver 210 generates control signals to map row data to specific source drivers 106 for output on a corresponding output channel. The display data receiver 210 also uses the global timing signals to generate signals to drive gate and source drivers, such as a gate driver clock signal and a source driver clock signal. The display data receiver 210 also uses the received global timing signals to generate control signals to refresh a frame of image data.

The display data receiver 210 is also configured to perform signal conditioning on the received data to adjust or modify one or more attributes of the received data so that the received data can be processed by the timing controller 104. For example, the display data receiver 210 extracts timing information associated from display data or control data to use in conjunction with control circuitry (e.g., shift registers, input registers, data latches, etc.) to condition image data for output by the source drivers 106. Alternatively or additionally, the display data receiver 210 descrambles the received data, decrypts encrypted data, or adjust the voltage, timing, or other characteristics of the received data to process display data by the display subsystem 100 in accordance with a specified system environment.

The display data analyzer 220 identifies attributes of the display data received by the display data receiver 210, and generates one or more data and control signals for displaying the received image data on the display region 102. Attributes of the received display data include data structure (e.g., a row of image data or a frame of image data) and signal type (e.g., image data, control data, or link status data). The display data analyzer 220 also derives other attributes of the received display data from signals provided by the display data receiver 210. For example, in one implementation, the display data analyzer 220 uses global timing and display data signals received over the display interface 108 to calculate a frame rate and a refresh rate for the incoming display data. The frame rate represents how often a display data source can feed an entire frame of new data to a display (e.g., display region 102). The refresh rate represents the number of times per second in which the display region 102 draws the display data provided by the source drivers 106. The display data analyzer 220 may include processing elements (e.g., combinational logic, controller, or processing device) configured to process attribute of the received display data.

The display data analyzer 220 also determines or derives additional control information using data received over display interface 108. In one implementation, the display data analyzer 220 identifies mapping information describing the mapping of row data to specified source driver 106 of a plurality of source drivers 106. Additional control information also includes polarity configuration information specifying a polarity inversion operation mode associated with the received display data. To prevent permanent damage to the sub-pixels within the display region 102, the display data analyzer 220 generates one or more control signals to alternate or invert the polarity of display data signals supplied to each sub-pixel between successive video frames. The source driver 106 changes the polarity of the output voltage signal applied to each output channel in accordance with state of the polarity inversion control signal.

The display data analyzer 220 is configured to implement any one or a combination of different inversion operation modes. For example, in frame inversion operation mode, all sub-pixels in the display panel region 102 are driven with the same polarity inversion control signal having a first state during even numbered (even) frames and a polarity inversion control signal having a second state during odd numbered (odd) frames. In column inversion operation mode, sub-pixels in adjacent columns are driven with opposite polarity image data signals and change polarity for each sequentially successive frames. Similarly, in row inversion operation mode, sub-pixels in adjacent rows are driven with opposite polarity image data signals and change polarity for each sequentially successive frame. Dot inversion operation mode employs a combination of the column and row inversion that causes a sub-pixel-by-sub-pixel inversion. In dot inversion operation mode, the polarity of the voltage level of the image data signals applied to each sub-pixel changes polarity relative to the polarity of the voltage level of the image data signal applied to an adjacent sub-pixel in the same row. The data polarity configuration information specifies how the timing controller 104 should employ one of several polarity inversion modes. Using the configuration information, the display data analyzer 220 generates one or more polarity control signals for setting the polarity of image data signals of the output by the source drivers 106 in accordance with a specified polarity inversion operation mode as previously discussed.

The display data analyzer 220 also generates an offset voltage control signal to adjust the input offset voltage of each output buffer included in each source driver 106. In one implementation, the display data analyzer 220 includes one or more chopper circuits that generate a chopper mode control signal having a first state in accordance with a first chopper mode and a second state in accordance with a second chopper mode. For example, the first state may correspond to a first voltage level (e.g., a logic "0") and the second state may correspond to a second voltage level (e.g., a logic "1") that is greater than the first voltage level. The chopper mode control signal is used to enable a particular chopper mode on the output buffer based on the state of the chopper mode control signal as further discussed with reference to FIG. 4.

In one embodiment, the display data analyzer 220 is configured to adaptively employ two types of chopper modes. A first chopper mode—chopper mode A—the output voltage of the output buffer has a positive offset relative to the input voltage of the output buffer. A second chopper mode—chopper mode B—the output voltage of the output buffer has a negative offset relative to the input voltage of the output buffer. In other implementations, chopper mode A adds the offset voltage to the input voltage of the output buffer and the chopper mode B subtracts the offset voltage from the input voltage of the output buffer. By dynamically employing chopper mode A and B, the averaged output voltage of the output buffer of each source driver 106 matches or is maintained within a threshold value of the input voltage. This in turn, reduces or removes the offset voltage of the output buffer. By removing the offset voltage of each output buffer, the display data analyzer 220 enables the timing controller 104 to provide display data with accurate gray levels for the sub-pixels within the display region 102.

The display data analyzer 220 generates a chopper mode A control signal alternatively with chopper mode B for sub-pixels considered to be the same. The sub-pixels are considered to be the same if gray level values of different sub-pixels are the same. The sub-pixels may be also considered to be the same if the difference of gray levels among different sub-pixels is within a gray level threshold. The gray level threshold may refer to a numerical value representing a maximum difference between gray level values. In one implementation, the gray level threshold can be an integer (e.g., 0, 1, or 2, . . . ). For example, a gray level threshold of zero indicates that the sub-pixel has a gray level value matched with the gray level value of a different sub-pixel. In another example, the gray level threshold can be a small value (e.g., 1 or 2). A gray level threshold may also refer to a range of numerical values specifying a threshold range (e.g., 0 to 2 or 0 to 1). In some implementations, the display data analyzer 220 generates a chopper mode control signal in a first state to apply a chopper mode A to a first sub-pixel, and generates a chopper mode control signal in a second state to apply a chopper mode B to a second sub-pixel considered as the same as the first sub-pixel.

The display data analyzer 220 transmits control signals to each output buffer in corresponding source driver 106 via the display data link 114 for display on the display region 102. The control signals include chopper mode control signals and polarity inversion mode control selection signals. The display data analyzer 220 dynamically selects how to employ various chopper modes to drive the output buffers included in each of the source drivers 106 based on analyzing the display data included in a frame of image data. For each frame of display data, the display data analyzer 220 analyzes the display data for one group of rows of the frame at a time. In one implementation, the display data analyzer 220 divides each frame of received display data into multiple search groups comprised of a selected number of adjacent rows. Dividing a frame into search groups allows the display analyzer 220 to process image data in groups of adjacent rows. Such a group-based analysis allows the display data analyzer 220 to compensate for input offset voltage in the output buffers more quickly compared to analyzing an entire frame of received image data. Example search groups may include 4 rows or 8 rows.

The display data analyzer 220 analyzes the image data within a first search group, followed by a subsequent search group that includes a next adjacent group of rows, until all the search groups within a frame of received image data are analyzed. In one example, the display data analyzer 220 defines a search group to include four rows. In this example, the first search group includes rows 1-4, a second search group includes rows 5-8, a third search group includes rows 9-12, and so on. For each search group, the display data analyzer 220 identifies a candidate row and sets a chopper mode for the candidate row. In one implementation, the candidate row is the first row (i.e., lowest numbered row) in the search group. The display data analyzer 220 compares the gray level values of the sub-pixels in the candidate row with the gray level values of the sub-pixels included in each of the remaining rows within the search group. The display data analyzer 220 sets a chopper mode A for each sub-pixel in the first row and compares the gray level values of the sub-pixels in the candidate row with the gray level values of the corresponding sub-pixels in the one of more remaining rows.

The display data analyzer 220 may employ one of multiple types of input offset voltage cancellation modes for each frame of image data based on an analysis of the gray level values of sub-pixels for each row in each search group. An input offset voltage cancelation mode refers to how the display data analyzer 220 selects which chopper mode to apply to each sub-pixel in each row of a given frame of image data to compensate for the input offset voltage of output buffers included in each source driver 106. In one implementation, the display data analyzer 220 employs one of three types of input offset voltage cancellation modes for each frame of received image data. The three input offset voltage cancellation modes include a row-based input offset voltage cancellation mode, a per-column row-based input offset voltage cancellation mode, and a sub-pixel-wise input offset voltage cancellation mode.

During the row-based input offset voltage cancellation mode, the data display analyzer 220 selects a candidate row within each search group and applies a first chopper mode to each sub-pixel in the candidate row. The data display analyzer 220 then compares the gray level value of each sub-pixel included in the candidate row with the gray level values for corresponding sub-pixels in at least one of the remaining rows (e.g., a first remaining row and a second remaining row) in the search group. When the comparison indicates that a row included in the search group includes sub-pixels that have gray level values matching those of the corresponding sub-pixels included in the candidate row, the data display analyzer 220 applies a second chopper mode to each sub-pixel included the row. This process is repeated for each search group included in the frame of image data as further described in FIGS. 5, 6A, 6B, 7A, and 7B.

During the per-column row-based input offset voltage cancellation mode, the data display analyzer 220 applies the row-based input offset voltage cancellation mode on a per-column basis. The display data analyzer 220 applies the same frame data analysis as performed in the row-based input offset voltage cancellation mode on a per-column basis. For example, for a first column coupled to a first source driver 106, the display data analyzer 220 applies a chopper mode control signal having a first state to apply a chopper mode A to the output buffer of the source driver 106 when writing display data to the sub-pixel in a first (Nth) row as a candidate row and compares the gray level values of one or more sub-pixels included in the candidate row to the gray level values of sub-pixels included in at least one of the remaining rows in a search group. If that comparison indicates that the difference between gray level value of a sub-pixel included in at least one of the remaining rows in the search group and the sub-pixel included in the candidate row is within a gray level threshold, the data display analyzer 220 applies a chopper mode control signal having a second state to apply a chopper mode B to the output buffer of the same source driver 106 when writing display data to the corresponding subsequent row (Nth+1). The display data analyzer 220 repeats the row-based input offset voltage cancellation mode for each column included in each search group included in a first frame. For example, for each of the remaining columns of the first frame, the display data analyzer 220 sets a chopper mode A for each sub-pixel in the first row as a candidate row within the 4-row search group. The display data analyzer 220 compares the first remaining row (e.g., the second row) or the second remaining row (e.g., the third row) with the candidate row. The display data analyzer 220 sets a chopper mode B for the sub-pixels in the row having the same sub-pixels and sets the chopper mode A and chopper mode B for sub-pixels in the remaining two rows, respectively. The display data analyzer 220 repeats the row-based input offset voltage cancellation mode for each column included in each 4-row search group within a first frame until all the 4-row search groups are analyzed. The display data analyzer 220 may set the chopper mode for each sub-pixel in subsequently received frames based on the set chopper mode in the first frame. In one implementation, the display data analyzer 220 may process frames in groups of four, and set the chopper mode for each sub-pixel in a subsequent three frames based on the set chopper mode in the first frame. Further explanation is described in conjunction with FIGS. 8, 9A, and 9B.

During the sub-pixel-wise input offset voltage cancellation mode, for each column within each search group included in a frame of image data, the display data analyzer 220 sets a first chopper mode for a sub-pixel in a first row (N). The display data analyzer 220 compares a gray level value of a sub-pixel in a subsequent row (Nth+1) with the gray level value of the corresponding sub-pixel in the previous rows (e.g., the first row (N)). If the gray level value of the sub-pixel in the subsequent row matches the gray level value of the sub-pixel in the first row, the display data analyzer 220 applies a second chopper mode to the sub-pixel in the second row, where the second chopper mode is different from the first chopper mode. Otherwise, the display data analyzer 220 applies the same chopper mode to the sub-pixel in the second row. More generally, on a per-column basis, this process compares the gray level value of a sub-pixel in a subsequent row, with the gray level value of one or more sub-pixels in previous rows until the data display analyzer 220 identifies a sub-pixel in a previous row that has a gray level value that matches the gray level value of the sub-pixel in the subsequent row, or until the last row of the search group is reached without finding a match. When a match is identified, the data display analyzer 220 changes the chopper mode applied to the sub-pixel in the subsequent row relative to the last state of the chopper mode in the row having the same gray level value as the sub-pixel in the subsequent row.

The data transmitter 230 transmits to each source driver 106 a portion of the image data received from the display interface 108 in accordance with the mapping information received by the display data receiver 210 via the display data link 114. In operation, the display data transmitter 230 sends, on a row-by-row basis, a portion of the row image data to each corresponding source driver 106 based on the mapping information. The display data transmitter 230 also generates one or more control signals to synchronize when each portion of a row of image data is written to each corresponding source driver 106. The display data transmitter 230 generates one or more additional control signals (e.g., source driver enable) to synchronize when each portion of row image data is output by each corresponding output buffer included in the source driver 106 for display on the display region 102.

Figure 3:
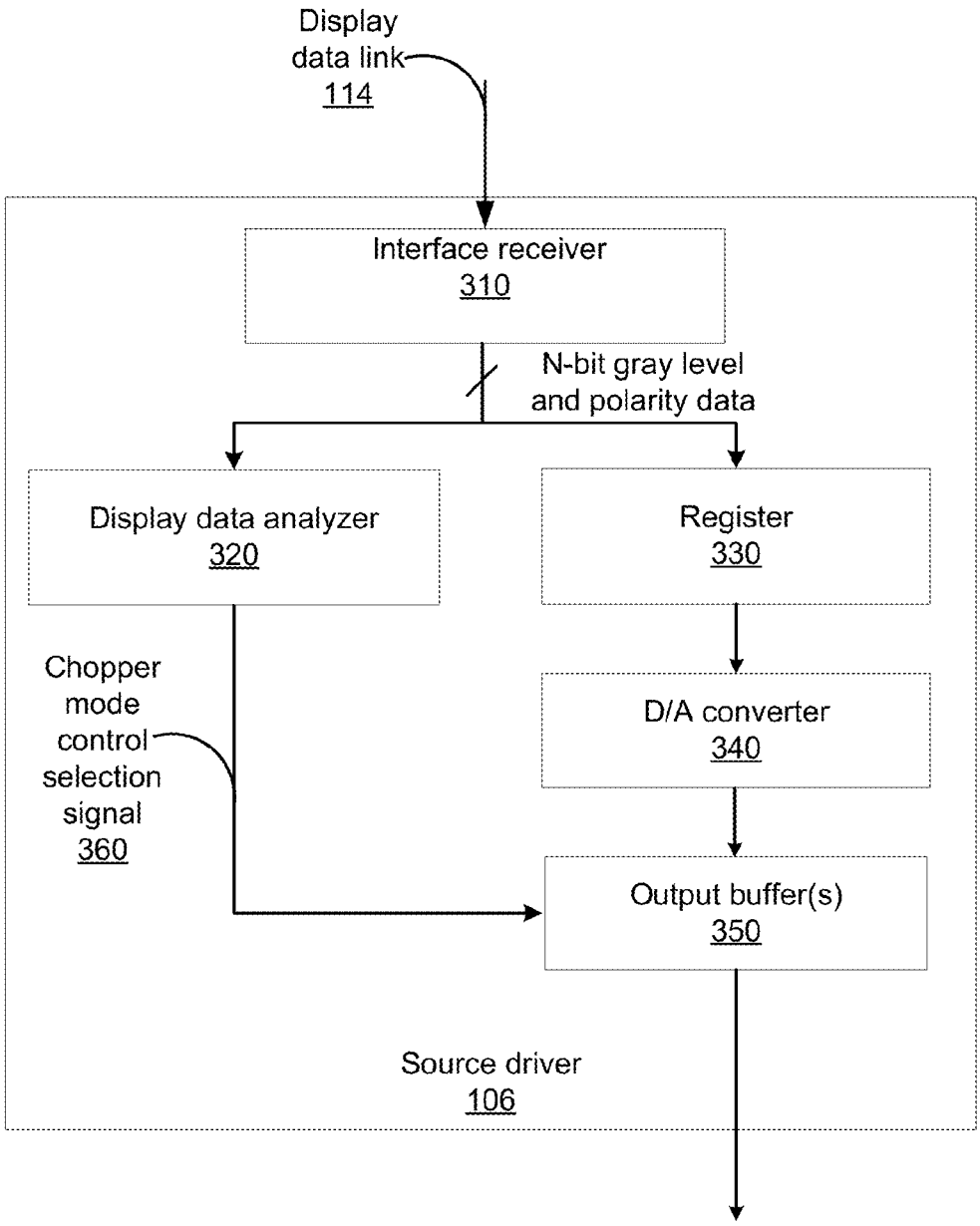
FIG. 3 illustrates a detailed view of a source driver of the display panel subsystem, in accordance with one embodiment.

FIG. 3 illustrates a detailed view of a source driver 106 of the display panel subsystem 100 in accordance with one embodiment. The source driver 106 includes an interface receiver 310, a display data analyzer 320, a register 330, a digital-to-analog (D/A) converter 340, and output buffers 350. The interface receiver 310 of a source driver 106 is configured to receive display data along with mapping information from the display data transmitter 230, and control signals from the display data analyzer 220 via display data link 114. The display data analyzer 320 has similar functions to the display data analyzer 220 and may operate in conjunction with the display data analyzer 220 included in the timing controller 104. In one implementation, the display data analyzer 320 receives display data from the timing controller 104 at the interface receiver 330 via the interface link 114. The display data analyzer 320 analyzes each frame included in the received display data and generates a chopper mode control signal to regulate the chopper mode applied to each sub-pixel based on the three types of display data analysis as previously described with reference to the display data analyzer 220 in FIG. 2. In other implementations, the display data analyzer 320 generates one or control signals for selecting polarity inversion mode or chopper mode control signal, while the display data analyzer 220 included in the timing controller 104 generates the other signal. The display data subsystem 100 may allocate functionality between the display data analyzer 220 and display data analyzer 320 based on one or more selectable configuration settings.

The register 330 is a general purpose storage element with sufficient storage capacity to store multi-bit digital information to drive multi-bit digital information in the source drivers 106 of the display panel subsystem 100. In one implementation, the multi-bit digital information corresponds to multi-bit gray levels, as mentioned earlier. The register 330 may be a single storage element, such as a shift register, or multiple storage elements configured to operate together to store received display data. In some implementations, the register 330 is segmented into multiple regions, each region assigned to store image data for a specified output channel. In some implementations, the register 330 includes circuitry to detect the value of a specified bit within a row of image data during a row image data write period, and determines whether the detected value for the same specified bit has changed during a subsequent row image data write period. In one implementation, the register 330 stores polarity data for selecting the polarity inversion operation modes of each output buffer 350. In another implementation, the register 330 stores polarity data for switching chopper modes of each output buffer 350.

The D/A converter 340 processes display data stored in the register 330 by converting the display data to analog signals having a voltage level that corresponds to the multi-bit digital value of the display data. Each output buffer 350 receives the analog voltage signals from the D/A converter 340 and/or amplifies the output of the D/A converter 340 for operating the active devices associated with sub-pixels within the associated column of the display panel 102. The further explanation of the output buffers 350 is described in conjunction with FIG. 4.

Figure 4:
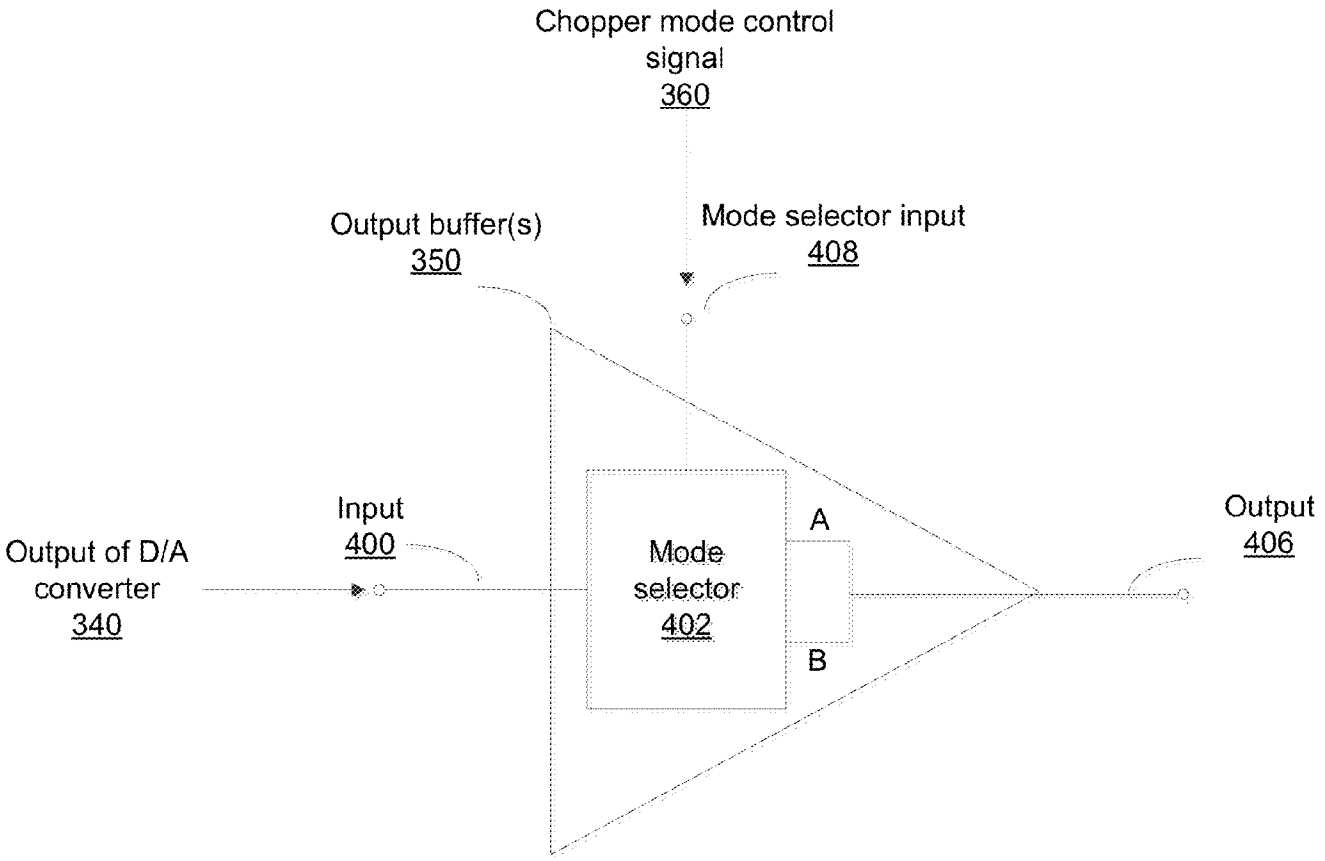
FIG. 4 illustrates a detailed view of an exemplary output buffer included in the source driver of FIG. 3 of the display panel subsystem, in accordance with one embodiment.

FIG. 4 illustrates a detailed view of an output buffer 350 included in the source driver 106 of the display panel subsystem 100 including a chopper mode selector 402 in accordance with one embodiment. For simplicity, one output buffer 350 is used for explanation. The output buffer 350 receive the analog voltage signals as an input 400 from the D/A converter 340 and the chopper mode control signal 360 from the display data analyzer 220 via the display data analyzer 320 of the source driver 106 or directly from the display data analyzer 320. The mode selector 402 selects chopper mode A or chopper mode B based on the state of the chopper mode control signal 360. In one implementation, the mode selector 402 includes two different output stages, a first stage having a negative offset voltage corresponding with chopper mode A and a second stage having a positive offset voltage corresponding to chopper mode B. In another implementation, the first stage has a positive offset voltage corresponding to chopper mode A and the second stage has a negative offset voltage corresponding to chopper mode B. Based on the state of the chopper mode control signal 360, the mode selector 402 enables either the first stage or the second stage of the mode selector 402 to cause the mode selector 402 to apply either a positive offset (e.g., chopper mode A) or a negative offset (e.g., chopper mode B) to the signal applied to the input 400 of the output buffer 350. In one implementation, when the chopper mode control signal 360 is in a first state, the mode selector 402 enables the first stage and disables the second stage. When the chopper mode control signal 360 is in a second state, the mode selector 402 enables the second stage and disables the first stage. In another implementation, when the chopper mode control signal 360 is in a first state, the mode selector 402 enables the second stage and disables the first stage, and when the chopper mode control signal 360 is in a second state, the mode selector 402 enables the first stage and disables the second stage. The output buffer 350 generates the output signal 406 based on the combination of analog voltage signals from the D/A converter 340 and the offset voltage applied by the mode selector 402. The value of the output signal 406 determines the gray level value applied to the active devices coupled to the sub-pixels within the associated column of the display panel 102. The value of the output signal 406 also applies the selected polarity operation mode and the selected chopper mode.

Figure 5:
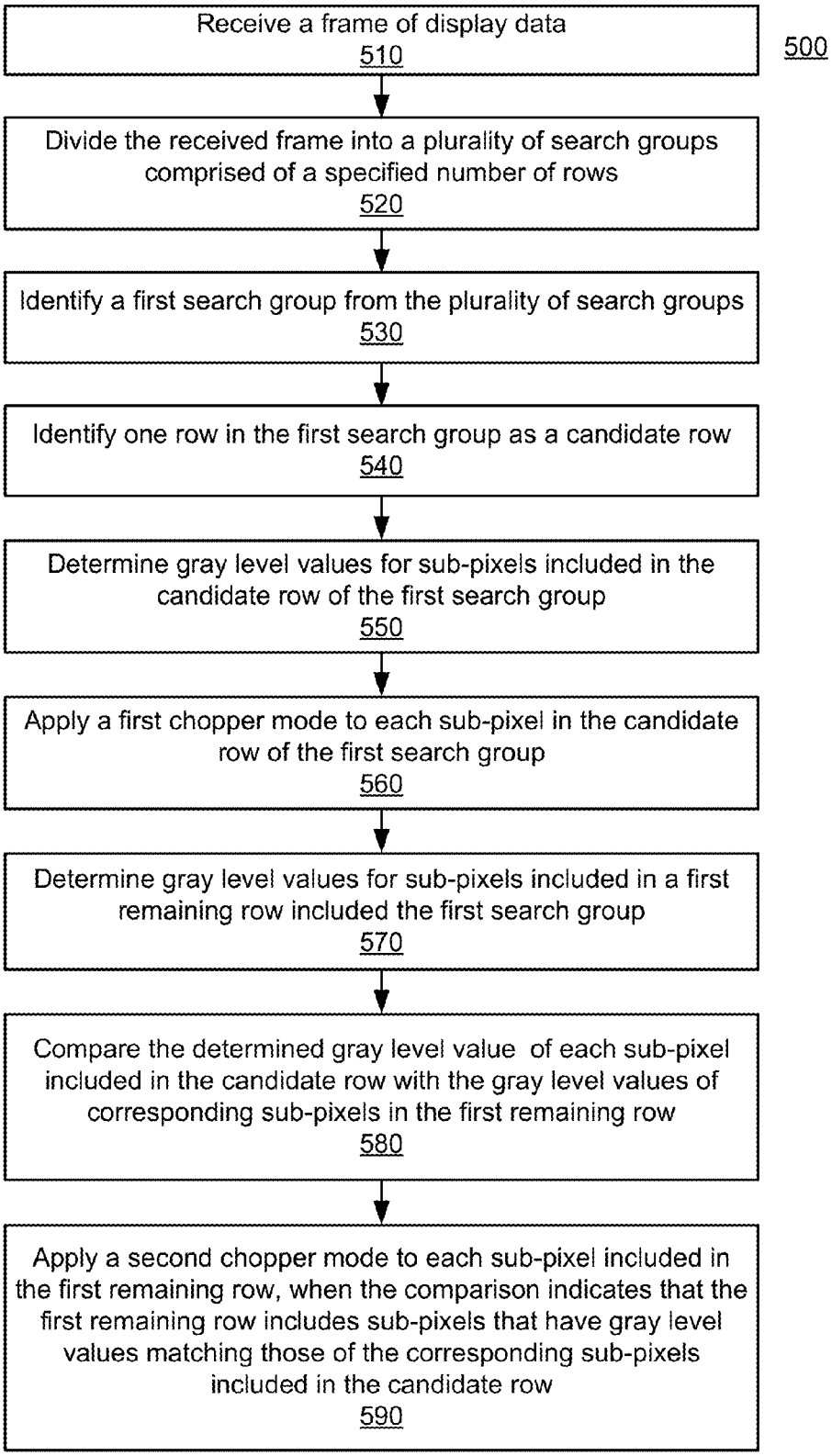
FIG. 5 illustrates a flowchart of one implementation of a process for removing input offset voltage of an output buffer in a display panel subsystem by employing a row-based input offset voltage offset cancellation mode, in accordance with one embodiment.

FIG. 5 illustrates a flowchart of one implementation of a process 500 for removing the input offset voltage of the output buffer 350 in a display panel subsystem 100 by employing a row-based input offset voltage cancellation mode in accordance with one embodiment. The process 500 may be performed by the data display analyzer 220 in some embodiments. As previously discussed with reference to the FIG. 3, the data display analyzer 320 included in the source driver 106 may perform similar functionality to the display data analyzer 220 included in the timing controller 104. Thus, the description of the functionality of the display data analyzer 220 also applies to the display data analyzer 320. Alternatively, other components may perform some or all of the steps of the process 500. Additionally, the process 500 may include different or additional steps than those described in conjunction with FIG. 5 in some embodiments or perform steps in different orders than the order described in conjunction with FIG. 5.

The data display analyzer 220 included in the timing controller 104 receives 510 a frame of display data from one source via the display interface 108. As previously described with reference to the display data receiver 210, the display data comprises of multiple frames of image data that represent one or more images for display on a display region 102 of the display panel subsystem 100. The display data received by the timing controller 104 also comprise one or more control signals used by other components of the display panel subsystem 100 to properly display each frame included in the received display data.

The data display analyzer 220 included in the timing controller 104 divides 520 the received frame into a plurality of search groups comprised of a specified number of rows. Example number of rows in specified search group may include 4 or 8 rows. In one implementation, timing controller 104 may store the received frame of display data in one or more memory elements for further processing by the timing controller 104.

The data display analyzer 220 included in the timing controller 104 identifies 530 a first search group from the plurality of search groups. For example, the display data analyzer 220 defines a search group to include four rows. In this example, the first search group includes rows 1-4, a second search group includes rows 5-8, a third search group includes rows 9-12, and so on.

The data display analyzer 220 included in the timing controller 104 identifies 540 one row in the search group as a candidate row. For example, the candidate row is the first row (i.e., lowest numbered row) in the first search group.

The display data analyzer 220 included in the timing controller 104 determines 550 gray level values for sub-pixels included in the candidate row of the first search group. The display data analyzer 220 may determine gray level of a sub-pixel by analyzing one or more attributes of the sub-pixels. Example attributes include gray level value and polarity. In one implementation, the data display analyzer 220 included in the timing controller 104 may retrieve the gray level value from the received frame of display data or determine the gray level value from other intensity or luminance information for a sub-pixel included in the received frame of display data. The display analyzer 220 determines a gray level value and polarity for each sub-pixel in the candidate row. In some implementations, the display analyzer 220 determines a gray level value and polarity for each sub-pixel at least one of the remaining rows (e.g., the first remaining row or the second remaining row).

The display data analyzer 220 included in the timing controller 104 applies 560 a first chopper mode to each sub-pixel in the candidate row of the first search group and determines 570 gray level values for corresponding sub-pixels included in a first remaining row included in the first search group. For example, the data display analyzer 220 applies a chopper mode control signal having a first state to the output buffers of the source drivers 106 when writing display data to the candidate row.

The display data analyzer 220 compares 580 the gray level value of each sub-pixel included in the candidate row with the gray level values for corresponding sub-pixels in at least one of the remaining rows in the search group. In some implementations, the first remaining row having matching gray level values of sub-pixels as those in the candidate row is adjacent to the candidate row. For example, the data display analyzer 220 applies a chopper mode control signal having a first state to the output buffers of the source drivers 106 when writing display data to the first row as the candidate row (Nth row). The first remaining row is the immediately subsequent row (Nth+1) to the candidate row. If the determined gray level values for the sub-pixels included in the candidate row matches or is within a gray level threshold value of the determined gray level values for the sub-pixels included in the first remaining row, the data display analyzer 220 applies a chopper mode control signal having a second state to the output buffers of the source drivers 106 when writing display data to the first remaining row. Such a row-based input offset voltage cancellation mode is referred to herein as a one-line row-based input offset voltage cancellation mode because a different chopper mode is applied to each adjacent row as further described in conjunction with FIGS. 6A and 6B.

In some implementations, the first remaining row having matching gray level values of sub-pixels as those in the candidate row is not adjacent to the candidate row. For example, the data display analyzer 220 applies a chopper mode control signal having a first state to the output buffers of the source drivers 106 when writing display data to the first row as the candidate row (Nth row). If the comparison indicates that a threshold number of sub-pixels in the candidate row (Nth row) do not have gray level values that match those of the corresponding pixels of the immediately subsequent row (Nth+1), the data display analyzer 220 repeats the sub-pixel gray level comparison with the gray level values of the corresponding sub-pixels in the next row (Nth+2). For example, the display data analyzer 220 may determine that the difference between the gray level values of sub-pixels of the candidate row (Nth) and corresponding sub-pixels of the (Nth+2) row match or are within a threshold gray level value. In which case, the data display analyzer 220 applies a chopper mode control signal having a second state to the output buffers of the source drivers 106 when writing display data to the (Nth+2) row, and applies a chopper mode control signal having a first and a second state to the output buffers of the source drivers 106 when writing display data to the (Nth+1) and (Nth+3) rows, respectively, as further described in conjunction with FIGS. 7A and 7B. Such a row-based input offset voltage cancellation mode is referred to herein as a two-line row-based input offset voltage cancellation mode because a different chopper mode is applied to each group of two adjacent rows within a search group. In other embodiments, greater than a two-line row-based input offset voltage cancellation mode may be employed based on the relative similarities between the gray level values of sub-pixels in one row to the gray level values of sub-pixels in one or more other rows of a search group.

Returning to FIG. 5, based on the comparison result, the data display analyzer 220 selects and applies a specified chopper mode to sub-pixels included in one or more specified rows of the remaining rows. Based on the comparison result, the data display analyzer 220 employs a specified chopper mode. In one implementation, if comparison result indicates that the determined gray level values for the sub-pixels included in the candidate row and the determined gray level values for the sub-pixels included in the first remaining row match or are within a gray level threshold, the data display analyzer 220 may apply 590 a different chopper mode from the chopper mode in the candidate row to the first remaining row. Alternatively, if the comparison result indicates that the determined gray level values for the sub-pixels included in the candidate row and the determined gray level values for the sub-pixels included in the first remaining row are greater than the gray level threshold, the data display analyzer 220 compares the determined gray level values for the sub-pixels included in the candidate row and the determined gray level values for the sub-pixels included in the second remaining row. If the comparison indicates the gray level values of the sub-pixels in the second remaining row (e.g., a third row) match the gray level values of the sub-pixels included in the candidate row (e.g., a first row), the data display analyzer 220 may apply 590 the same chopper mode to sub-pixels included in the candidate row and to the first remaining row. This process is repeated for each search group included in the frame of display data as further described in FIGS. 6A, 6B, 7A, and 7B.

Figure 6A:
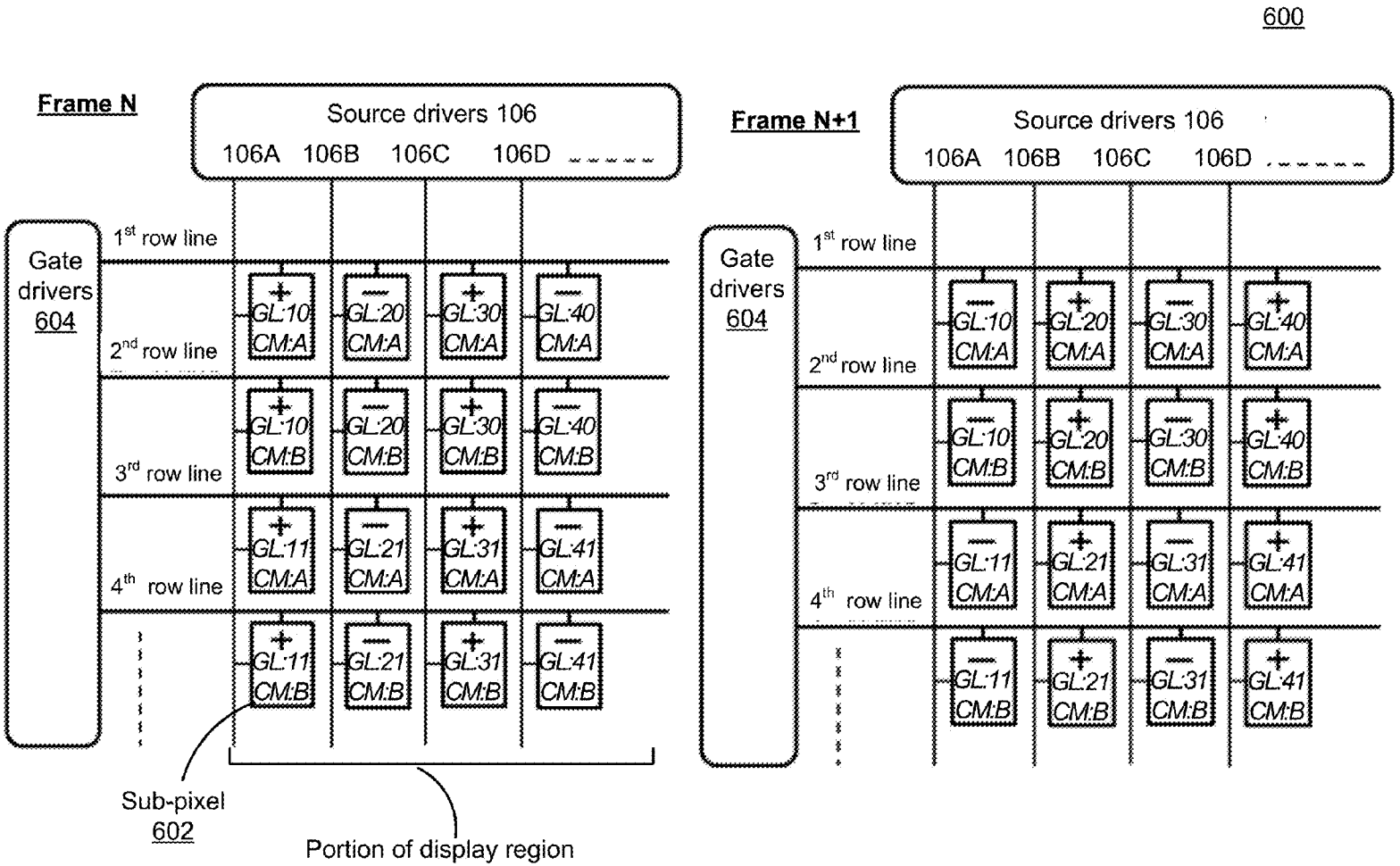
FIGS. 6A and 6B illustrate an example of the row-based input offset voltage cancellation mode illustrated in FIG. 5, in accordance with an embodiment.
Figure 6B:
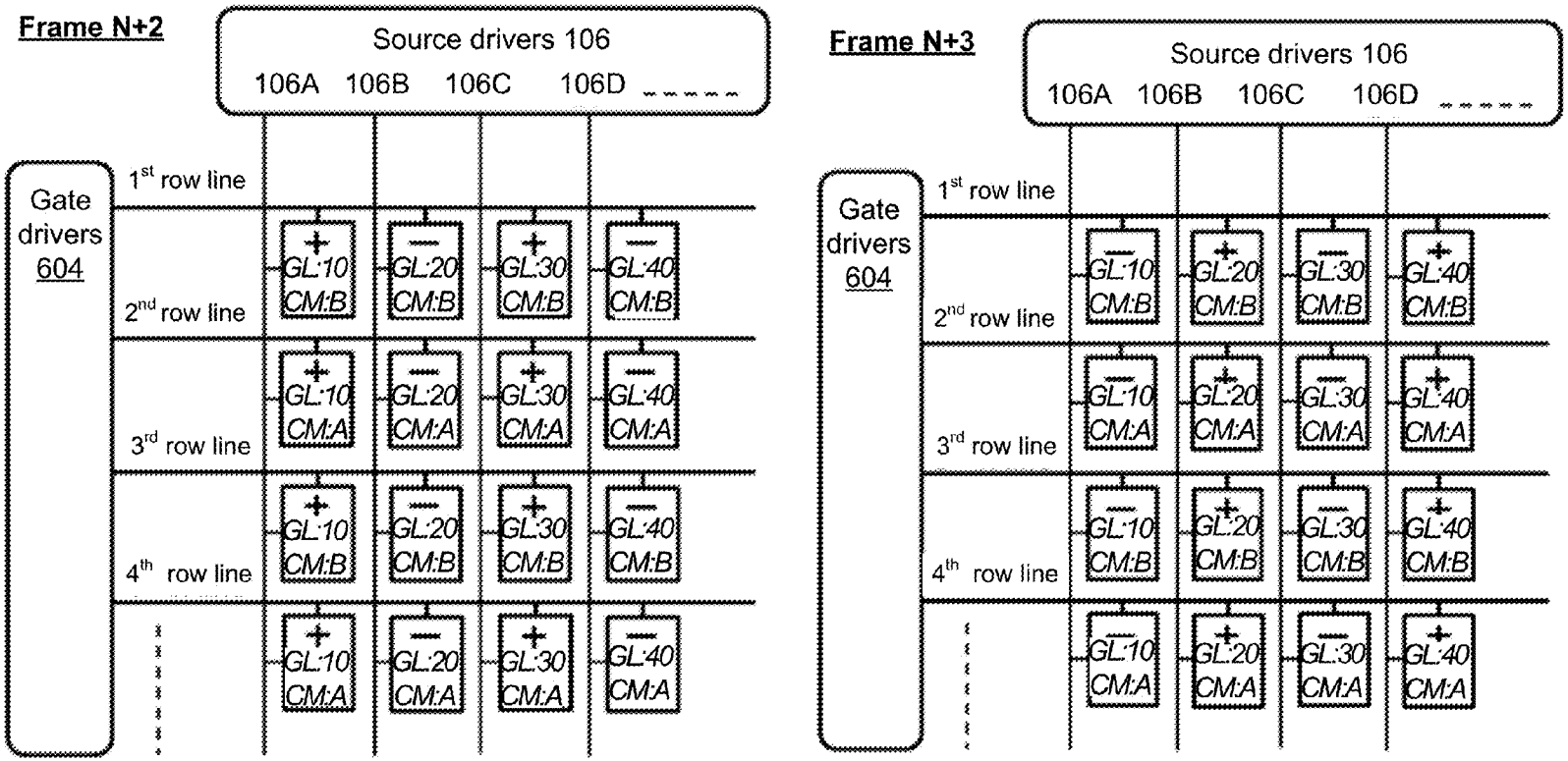

FIGS. 6A and 6B illustrate an example of the row-based input offset voltage cancellation mode illustrated in FIG. 5, in accordance with an embodiment. FIGS. 6A and 6B illustrate attributes of sub-pixels included in a 4-row search group of the display region 102 in which the display data analyzer 220 employs a row-based input offset voltage cancellation mode during successive frames of display data. As shown in FIG. 6A, the 4-row search group of the display region 102 includes an array of sub-pixels comprised of multiple columns and multiple rows. Each column of sub-pixels is electrically coupled to a source driver 106, and each row of sub-pixels is electrically coupled to a gate driver 604. Each sub-pixel includes an indication of polarity, gray level, and chopper mode.

The indication of polarity is represented by the symbols "+" and "−," corresponding to positive and negative polarity applied to sub-pixels in the search group of the display region 102, respectively. As shown in FIGS. 6A and 6B, for each successive frame (e.g., 4 frames N, N+1, N+2, N+3) a column inversion operation mode is applied to the sub-pixels in adjacent columns by the timing controller 104. Under a column inversion operation mode, sub-pixels in adjacent columns are driven with opposite polarity image data signals and change polarity for each sequentially successive frames. For example, for frame N, the timing controller 104 drives sub-pixels in a first column coupled to a source driver 106A with positive polarity image data signals, and drives sub-pixels in the adjacent column coupled to a source driver 106B with negative polarity image data signals. For frame N+1, the timing controller 104 drives sub-pixels in a first column coupled to a source driver 106A with negative polarity image data signals, and drives sub-pixels in the adjacent column coupled to a source driver 106B with positive polarity image data signals.

The indication of gray level of the sub-pixel is represented as "GL:[gray level value]." For example, the sub-pixel 602 coupled to the source driver 106A and the fourth row line of the gate driver 604, has gray level value of 11, represented as GL:11. The indication of chopper mode applied to a sub-pixel is represented by "CM:[chopper mode]." For example, the sub-pixels coupled to the fourth row line is set to a chopper mode B by applying a chopper mode control signal having a second state to the output buffers of source drivers 106A-106D. Whereas the sub-pixels coupled to the third row line of the gate driver 604 are set to a chopper mode A by applying a chopper mode control signal having a first state to the output buffers of source drivers 106A-106D.

In one embodiment under the row-based input offset voltage cancellation mode shown in FIGS. 6A and 6B, for a search group in each frame of image data, the data display analyzer 220 applies a selected chopper mode on a row-by-row basis. For example, in FIG. 6A the first row line of the gate driver 604 is identified as a candidate row with a chopper mode A. The gray levels of sub-pixels coupled to the candidate row are determined. The sub-pixels coupled to the candidate row have gray level values of 10, 20, 30, and 40, from the leftmost to the rightmost column, respectively. Here, the sub-pixels coupled to the second row line also have gray levels of 10, 20, 30, and 40, from the leftmost column to the rightmost column, respectively. In turn, the display data analyzer 220 sets the chopper mode for sub-pixels in the second row line to be different from the chopper mode of the sub-pixels included in the candidate row. The display data analyzer 220 sets the chopper mode A for sub-pixels in the third row line and sets the chopper mode B for the sub-pixels in the fourth row line. The process is repeated for the remaining search groups until all the search groups are analyzed. The chopper modes for sub-pixels in subsequent frame N+1, and frames N+2 and N+3, shown in FIG. 6B, are applied in accordance with the chopper modes applied to corresponding sub-pixels in frame N.

Figure 7A:
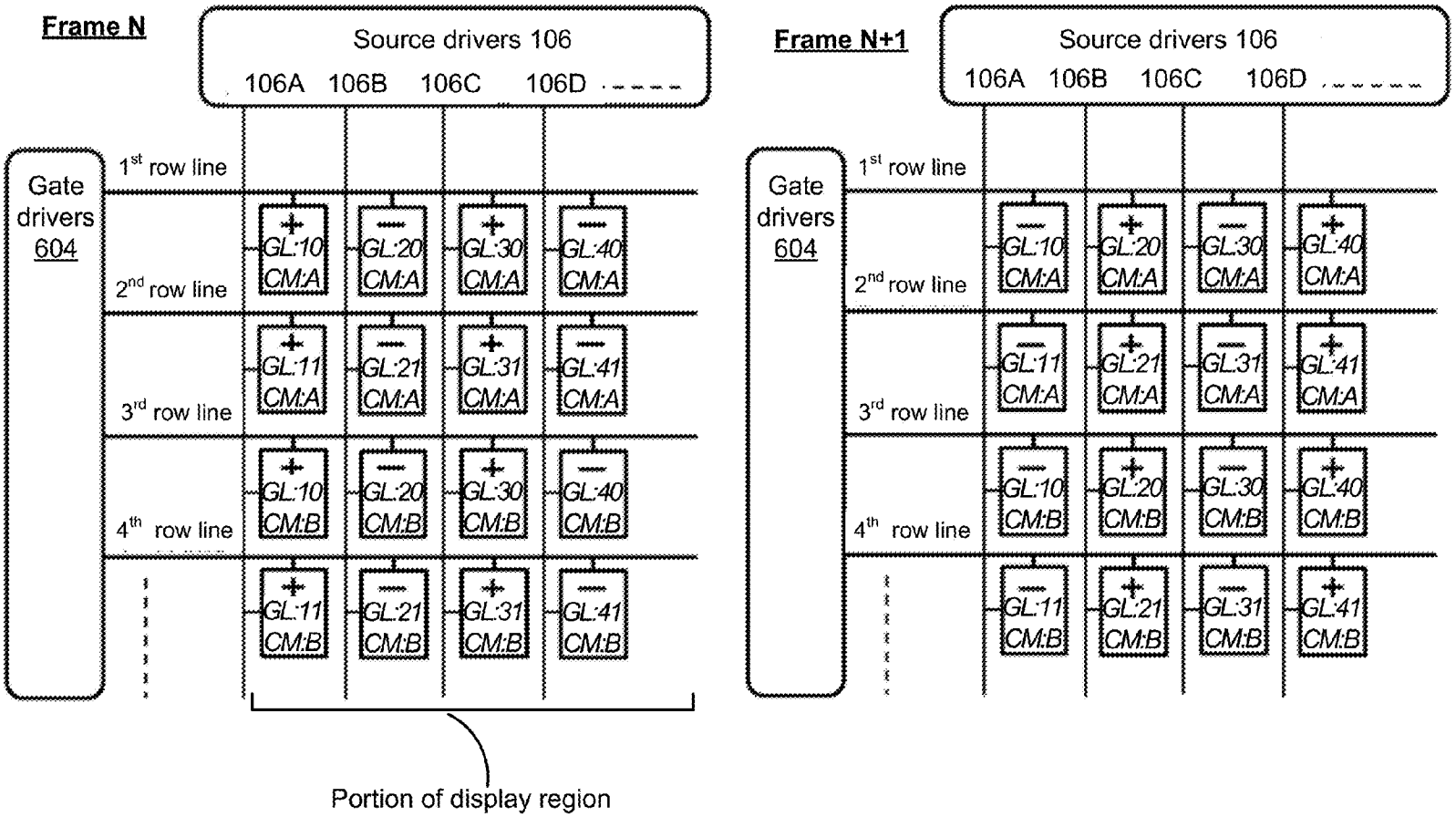
FIGS. 7A and 7B illustrate another example of the row-based input offset voltage cancellation mode illustrated in FIG. 5, in accordance with an embodiment.
Figure 7B:
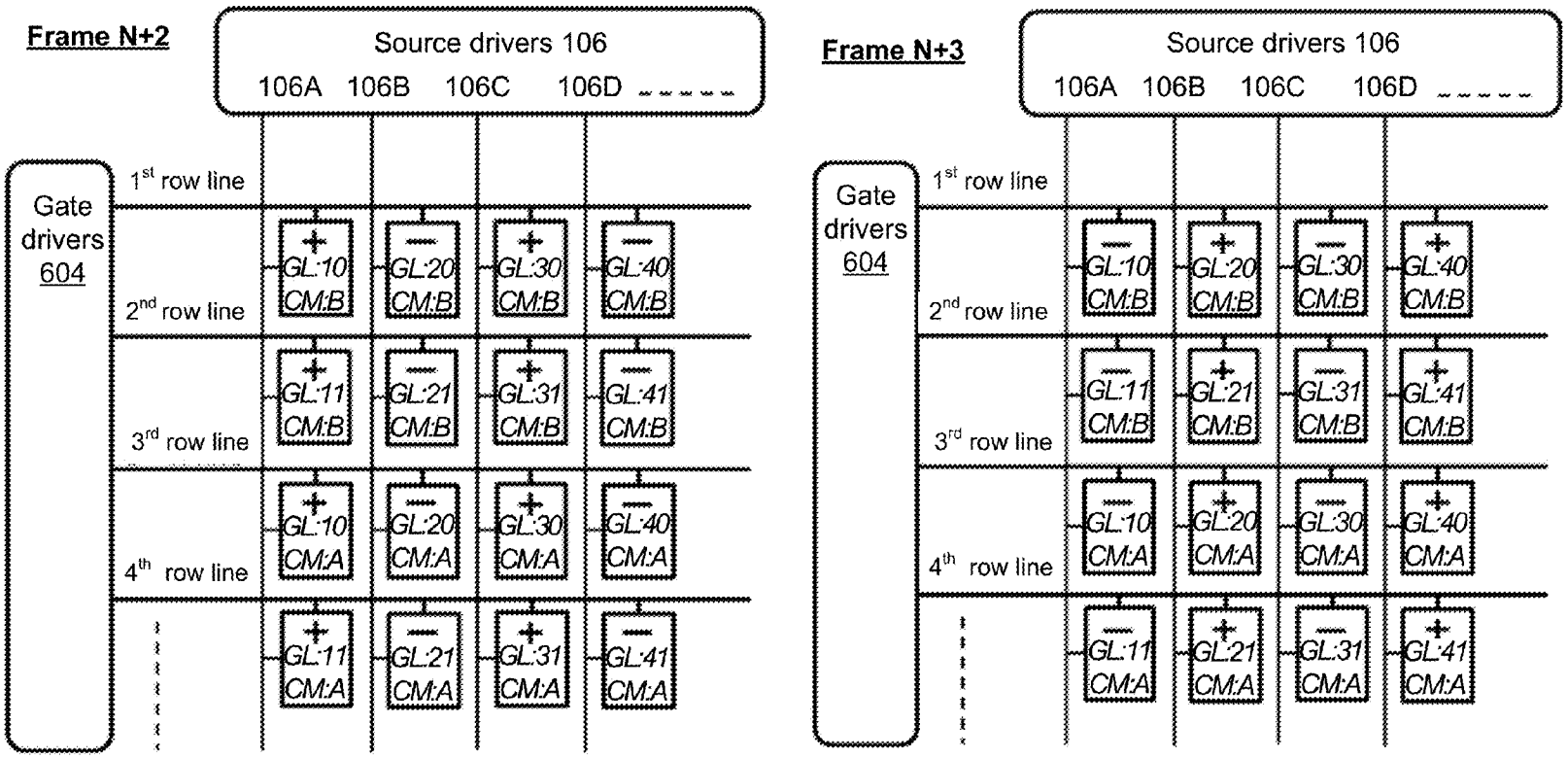

In one embodiment under the row-based input offset voltage cancellation shown in FIGS. 7A and 7B, for a search group in each frame of image data, in FIG. 7A the first row is identified as a candidate row with chopper mode A. The sub-pixels coupled to the candidate row and third row line have gray level values of 10, 20, 30, and 40, from the leftmost to the rightmost column, respectively. While, the sub-pixels coupled to the second row line and fourth row line also have gray levels of 11, 21, 31, and 41, from the leftmost column to the rightmost column, respectively. In turn, the display data analyzer 220 applies different chopper mode (e.g., chopper mode B) from the candidate row for the sub-pixels in the third row line, while applying a chopper mode A for sub-pixels in the second row and chopper mode B for sub-pixels in the fourth row. The chopper modes for the sub-pixels in subsequent frame N+1, and frames N+2 and N+3 are applied based on the frame N shown in FIG. 7B. The process is repeated for the remaining search groups until all the search groups are analyzed.

Figure 8:
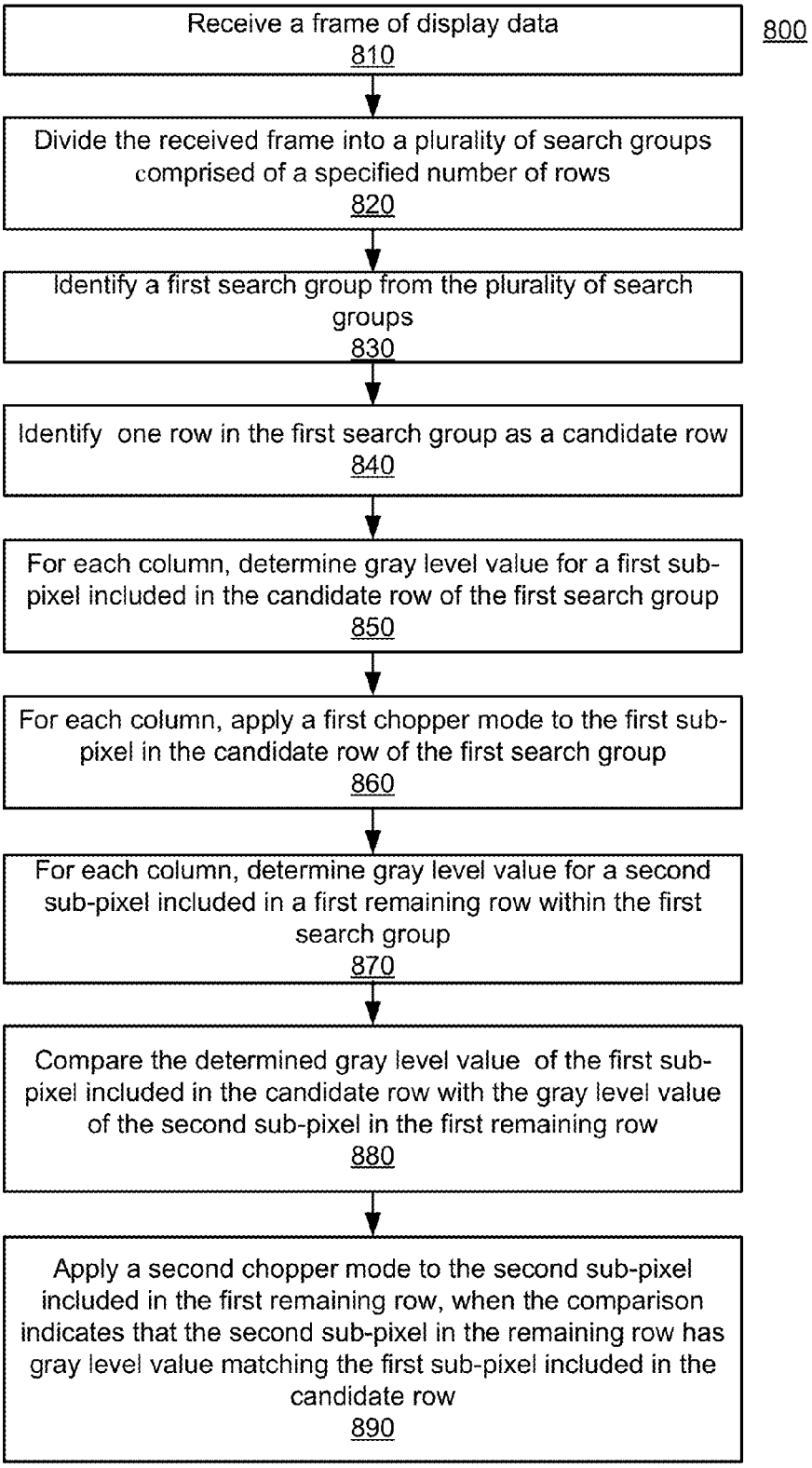
FIG. 8 illustrates a flowchart of one implementation of a process for removing input offset voltage of an output buffer in a display panel subsystem by employing a per-column row-based input offset voltage cancellation mode, in accordance with one embodiment.

FIG. 8 illustrates a flowchart of one implementation of a process 800 for removing the input offset voltage of an output buffer 350 in a display panel subsystem 100 by employing the row-based input offset voltage cancellation mode 500 described in FIG. 5 on a column-by-column basis (also referred to as a per-column row-based input offset voltage cancellation mode) in accordance with one embodiment. The process 800 may be performed by the data display analyzer 220 in some embodiments. As previously discussed with reference to the FIG. 3, the data display analyzer 320 included in the source driver 106 may perform similar functionality to the display data analyzer 220 included in the timing controller 104. Thus, the description of the functionality of the display data analyzer 220 also applies to the display data analyzer 320. Alternatively, other components may perform some or all of the steps of the process 800. Additionally, the process 800 may include different or additional steps than those described in conjunction with FIG. 8 in some embodiments or perform steps in different orders than the order described in conjunction with FIG. 8.

The display data analyzer 220 receives 810 a frame of display data from one source via the display interface 108 and divides 820 the received frame into a plurality of search groups comprised of a specified number of rows in manner similar as described with reference to steps 510 and 520 in FIG. 5. The display data analyzer 220 identifies 830 a first search group from the plurality of search groups and identifies 840 one row in the search group as a candidate row (e.g., a sub-pixel in the first column and the first row of the search group), in manner similar as described with reference to steps 530 and 540 in FIG. 5. For each column in a search group of the display region 102, the display data analyzer 220 determines 850 the gray level value for a first sub-pixel included in the candidate row of the search group of display data, applies 860 a first chopper mode to the first sub-pixel included in the candidate row of the first search group, and determines 870 the gray level for a second sub-pixel in a first remaining row (e.g., a sub-pixel in the first column and the second row of the search group) included in the search group. In some embodiments, the display data analyzer 220 determines the gray level for a third sub-pixel in a second remaining row (e.g., a sub-pixel in the first column and the third row of the search group). In another implementation, for a search group in each frame, the display data analyzer 220 may determine the gray level for sub-pixels included in multiple rows of the search group at the same time.

The display data analyzer 220 compares 880 the gray level value for the analyzed sub-pixels. Based on the comparison result, the data display analyzer 220 applies 890 a specified chopper mode to a sub-pixel included in a specified row and a specified column. In particular, for each column, the data display analyzer 220 compares the gray level value of the sub-pixels included in the candidate row and the corresponding sub-pixels in one or more specified rows. Based on the comparison result, the data display analyzer 220 employs a specified chopper mode.

In one implementation, for each column, if the comparison result indicates that the gray level value for the first sub-pixel included in the candidate row (e.g., a sub-pixel in the first column and the first row) of the search group and the determined gray level value for the second sub-pixel included in the first remaining row (e.g., a sub-pixel in the first column and the second row) of the search group matches, the data display analyzer 220 applies a different chopper mode from the candidate row to the second sub-pixel in the first remaining row with the matching sub-pixel gray level value. On the other hand, for each column, if the comparison result indicates that the determined gray level value for the first sub-pixel included in the candidate row of the search group and the determined gray level value for the second sub-pixel included in the first remaining row and the first column of the search group don't match, the data display analyzer 220 compares the determined gray level values for the first sub-pixel included in the candidate row and the determined gray level values for the third sub-pixel included in the second remaining row (e.g., a sub-pixel in the first column and third row). If the comparison indicates the third pixel in the second remaining row matches the first pixel in the candidate row, the data display analyzer 220 applies the same chopper mode to the first sub-pixel in the candidate row and the second sub-pixel in the first remaining row. The process is repeated for each column in the search group, and for each search group included in the frame of display data as further described in FIGS. 9A, and 9B.

Under the per-column row-based input offset voltage cancellation mode, the display data analyzer 220 may apply a different row-based input offset voltage cancellation mode to different columns in the search group of each frame of image data. For example, as previously described with reference to FIG. 5, the data display analyzer 220 operating in the row-based may apply a one-line, two-line, or other multi-line row-based input offset voltage cancellation mode. When applied in the column-based input offset voltage cancellation mode, the display data analyzer 220 may independently apply a different row-based input offset voltage cancellation to the sub-pixels in each column.

Figure 9A:
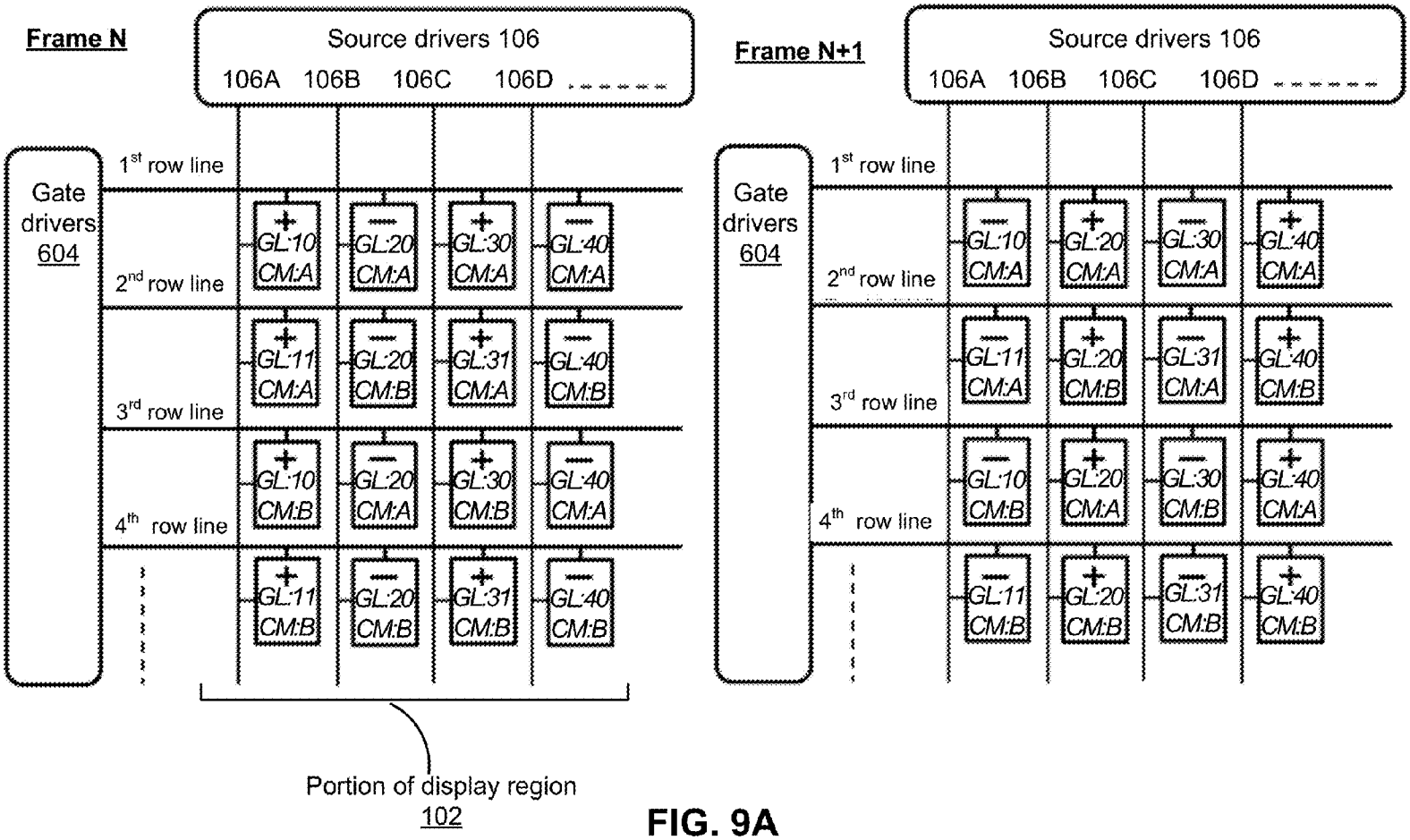
FIGS. 9A and 9B illustrate an example of the per-column row-based input offset voltage cancellation mode illustrated in FIG. 8, in accordance with an embodiment.
Figure 9B:
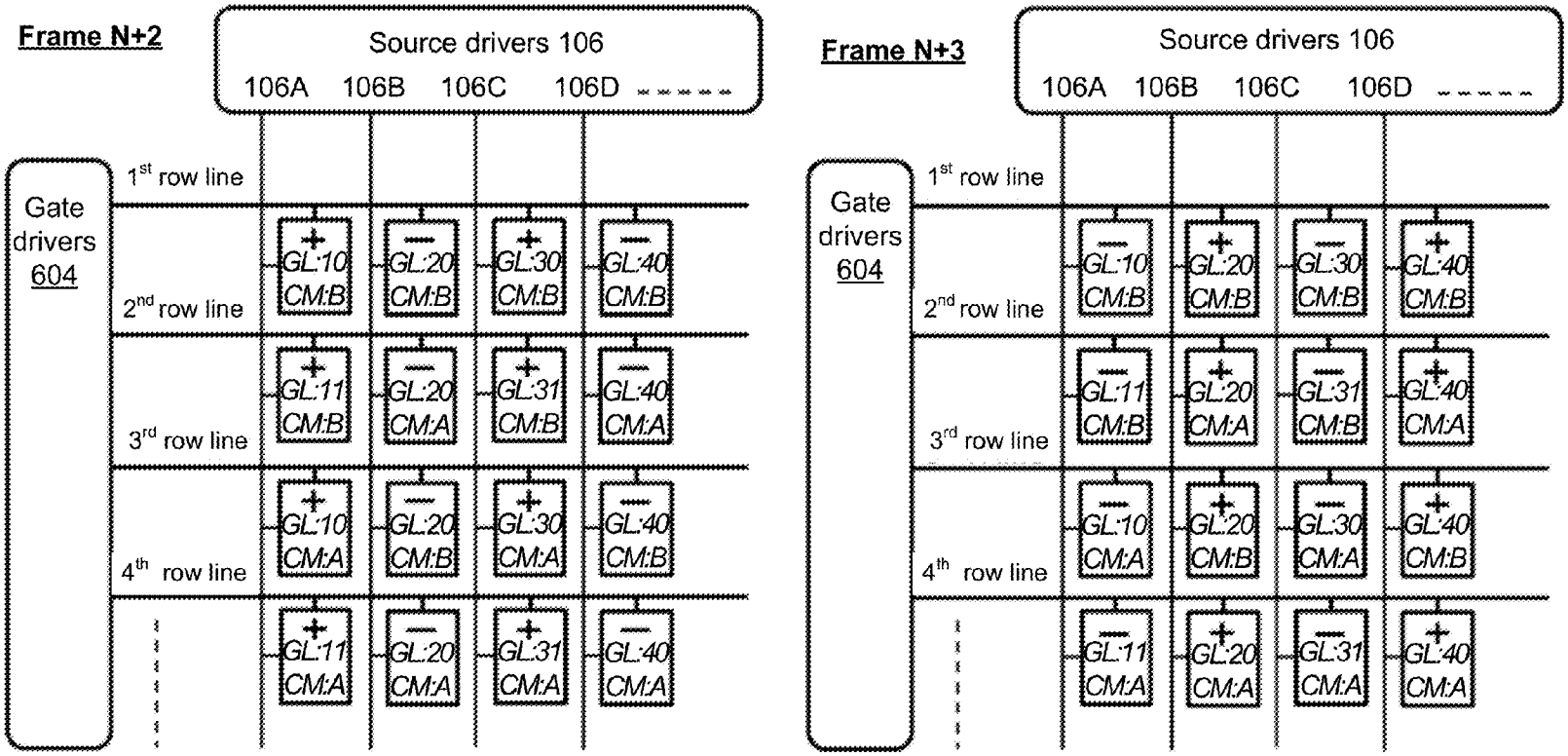

FIGS. 9A and 9B illustrate an example of the per-column row-based input offset voltage cancellation mode illustrated in FIG. 8, in accordance with an embodiment. FIGS. 9A and 9B illustrate attributes of sub-pixels included in a 4-row search group of the display region 102 in which the display data analyzer 220 employs a row-based input offset voltage cancellation mode on a column-by-column basis during successive frames of display data. In one embodiment under the per column row-based input offset voltage cancellation mode shown in FIGS. 9A and 9B, for each frame of image data, the data display analyzer 220 applies a selected chopper mode on a row-by-row basis for each column independently, unlike the row-based input offset voltage cancellation mode of FIGS. 5, 6A, 6B, 7A and 7B. FIGS. 9A and 9B show a 4-row search group of the display region 102 in which, for each of successive frames N, N+1, N+2, and N+3 different types of row-based input offset voltage cancellation modes are applied to sub-pixels coupled to the outputs of different source drivers 106. For example, a two-line row-based input offset voltage cancellation mode is applied to sub-pixels coupled to the output source drivers 106A and 106C, while a one-line row-based input offset voltage cancellation mode is applied to the sub-pixels coupled to the output of source drivers 106B and 106D. In other embodiments, greater than a two line row-based input offset voltage cancellation mode may be applied to sub-pixels, and other combinations of row-based input offset voltage cancellation modes may be applied to a search group of image data as previously described with reference to FIG. 5.

Figure 10:
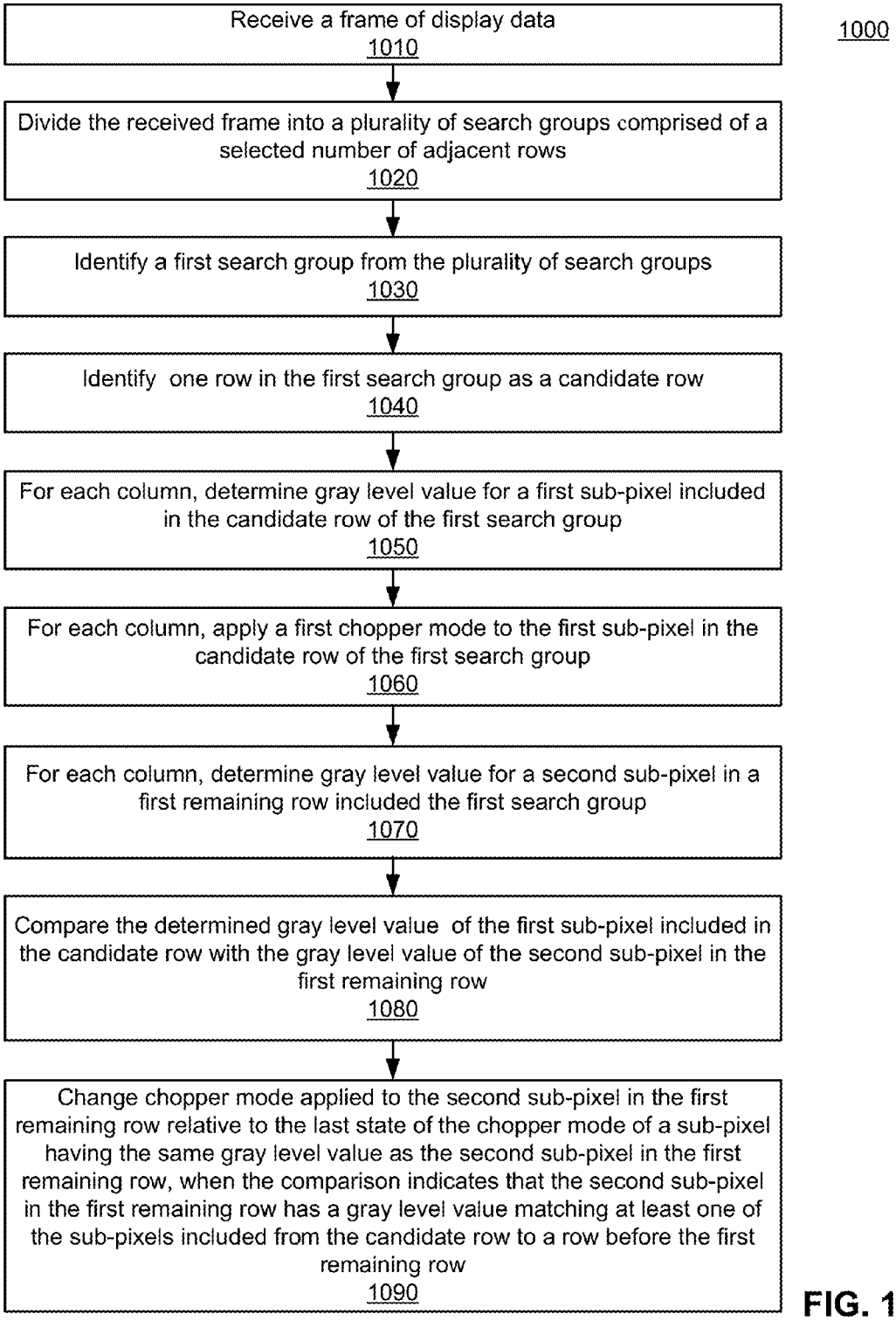
FIG. 10 illustrates a flowchart of one implementation of a process for removing input offset voltage of an output buffer in a display panel subsystem by employing a sub-pixel-wise input offset voltage cancellation mode, in accordance with one embodiment.

FIG. 10 illustrates a flowchart of one implementation of a process 1000 for removing the input offset voltage of an output buffer 350 in a display panel subsystem 100 by employing sub-pixel-wise input offset voltage cancellation mode in accordance with one embodiment. The process 1000 may be performed by the data display analyzer 220 in some embodiments. As previously discussed with reference to the FIG. 3, the data display analyzer 320 included in the source driver 106 may perform similar functionality to the display data analyzer 220 included in the timing controller 104. Thus, the description of the functionality of the display data analyzer 220 also applies to the display data analyzer 320. Alternatively, other components may perform some or all of the steps of the process 1000. Additionally, the process 1000 may include different or additional steps than those described in conjunction with FIG. 10 in some embodiments or perform steps in different orders than the order described in conjunction with FIG. 10.

As previously discussed with reference to FIG. 2, under the sub-pixel-wise input offset voltage cancellation mode, for each column within a search group for a frame of display data, the display data analyzer 220 sets a first chopper mode for a sub-pixel in a first row (N). The display data analyzer 220 compares a gray level value of a sub-pixel in a subsequent row (Nth+1) with the corresponding gray level value of the sub-pixel in the previous rows (e.g., the first row (N)). If the gray level value of the sub-pixel in the subsequent row matches the gray level value of the sub-pixel in the first row, the display data analyzer 220 applies a second chopper mode to the sub-pixel in the second row, where the second chopper mode is different from the first chopper mode. Otherwise, the display data analyzer 220 applies the same chopper mode to the sub-pixel in the second row. More generally, on a per-column basis, this process compares the gray level value of a sub-pixel in a subsequent row, with the gray level value of one or more sub-pixels in previous rows until the data display analyzer 220 identifies a sub-pixel in a previous row that has a gray level value that matches the gray level value of the pixel in the subsequent row, or until the last row of the search group is reached without finding a match. When a match is identified, the data display analyzer 220 changes the chopper mode applied to the sub-pixel in the subsequent row relative to the last state of the chopper mode in the row having the same gray level value as the sub-pixel in the subsequent row.

The display data analyzer 220 receives 1010 a frame of display data from one source via the display interface 108 and divides 1020 the received frame into a plurality of search groups comprised of a selected number of adjacent rows in manner similar as described with reference to steps 510 and 520 in FIG. 5. The display data analyzer 220 identifies 1030 a first search group from the plurality of search groups. For each search group, the data display analyzer 220 identifies 1040 one row in the search group as a candidate row in manner similar as described with reference to steps 530 and 540 in FIG. 5. For each column in an identified search group of the display region 102, the display data analyzer 220 determines 1050 the gray level value for a first sub-pixel included in the candidate row (e.g., a sub-pixel in the first column and the first row), applies 1060 a first chopper mode to the first sub-pixel in the candidate row, and determines 1070 the gray level for a second sub-pixel in a first remaining row (e.g., a sub-pixel in the first column and the second row) included in the search group. In some implementations, the display data analyzer 220 determines the gray level for a third sub-pixel in a second remaining row (e.g., a sub-pixel in the first column and the third row of the search group). In another implementation, for search group in each frame, the display data analyzer 220 may determine the gray level for sub-pixels included in multiple rows of the search group at same time. In some implementations, the order in which the display data analyzer 220 performs a row-by-row analysis of sub-pixels included in the respective rows may be performed sequentially, or in any other specified order. For example, after determining the gray levels values and polarities of the candidate row, the display analyzer 220 determines a gray level value and polarity for each sub-pixel included in at least one of the remaining rows within the first search group. The display data analyzer 220 compares 1080 the gray level value for the analyzed sub-pixels. Based on the comparison result, the data display analyzer 220 applies a specified chopper mode to a sub-pixel included in a specified row and a specified column. In one embodiment, if the comparison result indicates that the determined gray level value of the second sub-pixel in the first remaining row and the determined gray level value of the first sub-pixel in the candidate row match, or within a gray level threshold value, the display data analyzer 220 changes 1090 the chopper mode applied to the second sub-pixel in the first remaining row relative to the chopper mode applied to the first sub-pixel in the candidate row. The display data analyzer 220 then determines a gray level value for the third sub-pixel in a second remaining row included in the search group and compares the gray level value of the third sub-pixel in the second remaining row with the gray level of the second pixel in the first remaining row and the gray level of the first sub-pixel in the candidate row. If the gray level value of the third sub-pixel matches the gray level value of the first sub-pixel in the candidate row, the display data analyzer 220 changes the chopper mode applied to the third sub-pixel in the second remaining row relative to the chopper mode applied to the second sub-pixel in the first remaining row.

On the other hand, if the comparison indicates that the difference between the gray level value of the second sub-pixel in the first remaining row and the gray level value of the sub-pixel included from the candidate row exceeds the gray level threshold, the display data analyzer 220 maintains the state of the chopper mode control signal applied to the second sub-pixel in the remaining row as same as the state of the chopper mode control signal applied to the first sub-pixel in the candidate row. The display data analyzer 220 then determines a gray level value for the third sub-pixel in the second remaining row included in the search group and compares the gray level value of the third sub-pixel in the second remaining row with the gray level of the second pixel in the first remaining row and the gray level of the first sub-pixel in the candidate row. If the gray level value of the third sub-pixel matches the gray level value of the first sub-pixel in the candidate row, the display data analyzer 220 changes the chopper mode applied to the third sub-pixel in the second remaining row relative to the chopper mode applied to the first sub-pixel in the candidate row.

Figure 11A:
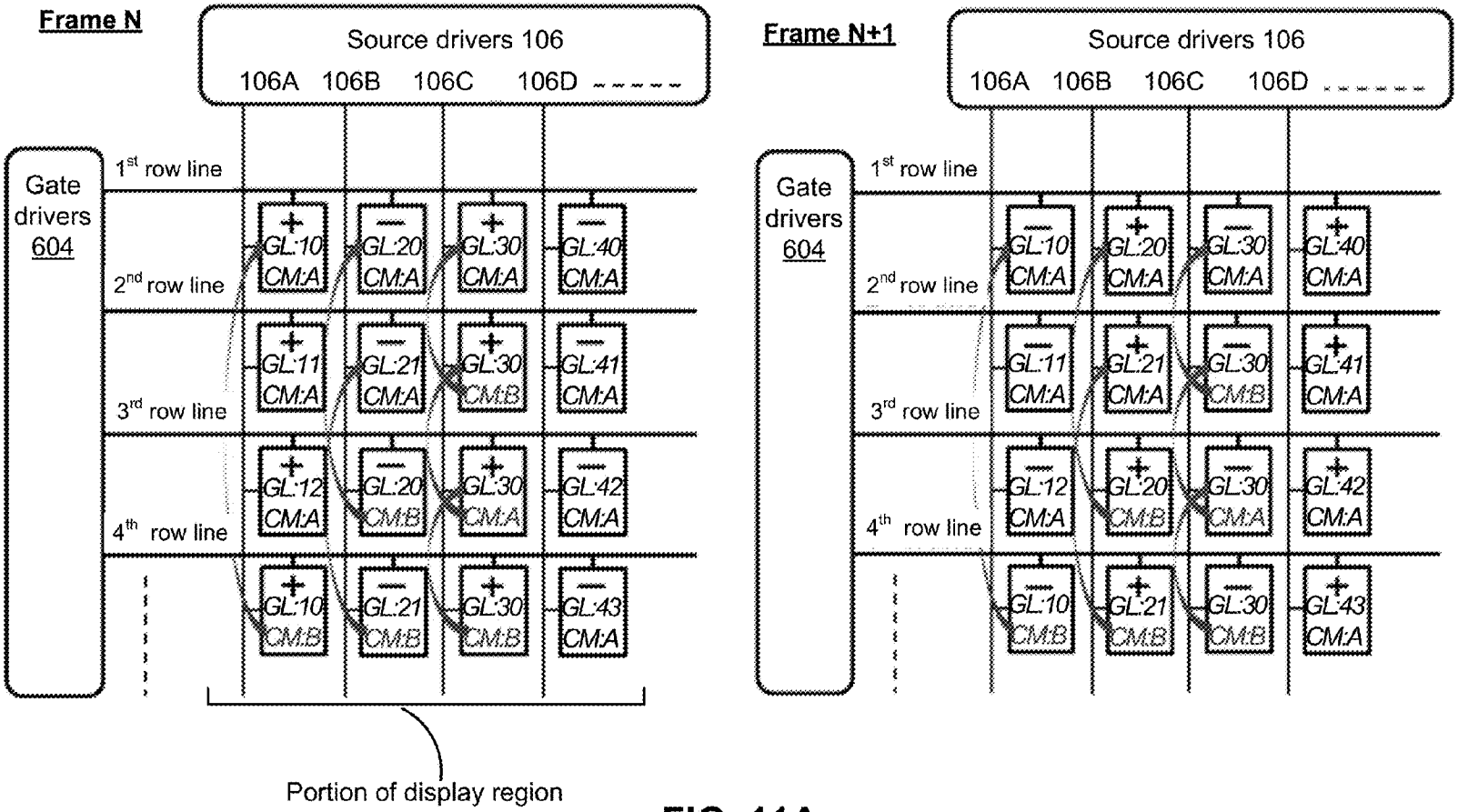
FIGS. 11A and 11B illustrate an example of the sub-pixel-wise input offset voltage cancellation mode illustrated in FIG. 10, in accordance with an embodiment.
Figure 11B:
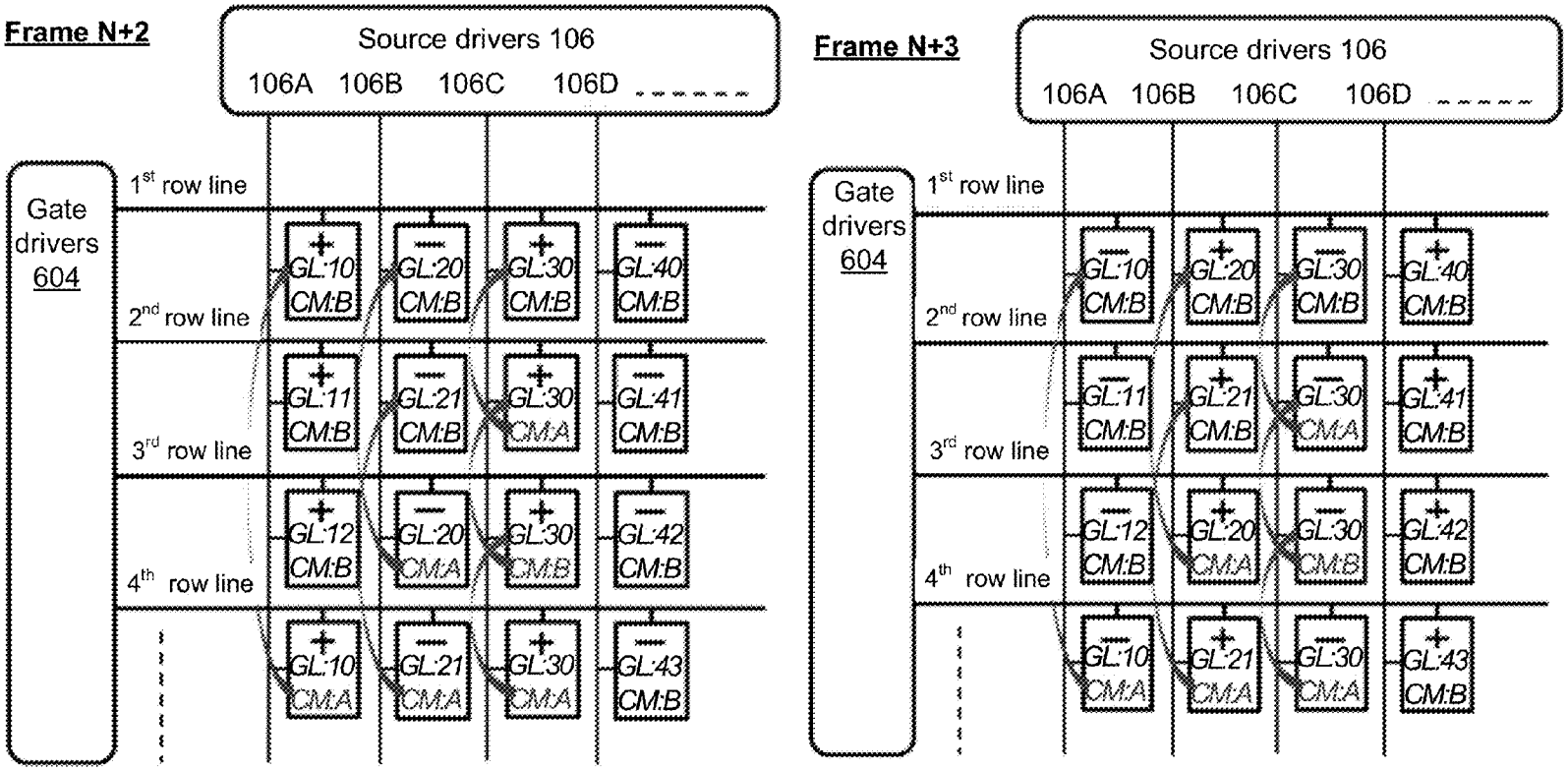

FIGS. 11A and 11B illustrate an example of the sub-pixel-wise input offset voltage cancellation mode illustrated in FIG. 10, in accordance with an embodiment. FIGS. 11A and 11B illustrate attributes of sub-pixels included in a search group of the display region 102 in which the display data analyzer 220 employs sub-pixel-wise input offset voltage cancellation mode during successive frames of display data. In one embodiment under the sub-pixel-wise input offset voltage cancellation mode shown in FIGS. 11A and 11B, for each search group in each frame and for each column, the data display analyzer 220 applies a specified chopper mode for a sub-pixel in every (Nth+1) row based on the gray level values of the sub-pixels in the previous N number of rows (e.g., from the candidate row to a row before the subsequent row). The data display analyzer 220 changes the chopper mode applied to the sub-pixel in the (Nth+1) row relative to the last state of the chopper mode in a sub-pixel having the same gray level value as the sub-pixel in the (Nth+1) row, when a comparison indicates that sub-pixel in the (Nth+1) row has a gray level value matching at least one of the sub-pixels included in previous N rows.

For example, as shown in FIG. 11A, for frame N, the sub-pixels coupled to the source driver 106A, referred to column 1 in this example, have gray level values of 10, 11, 12, and 10, corresponding to row lines 1, 2, 3, and 4 of the gate driver 604. If a chopper mode A is applied to the sub-pixel coupled to column 1-line 1, then the same chopper mode is applied to the sub-pixels coupled to column 1-line 2 and column 1-line 3 because the gray level values of 11 and 12 are not the same as the gray level value 10 of the sub-pixel coupled to column 1-line 1. The gray level value of the sub-pixel coupled to column 1-line 4 has the same gray level value of the sub-pixel coupled to column 1-line 1. Accordingly, the chopper mode B is applied to the sub-pixel at column 1-line 4. This process is repeated for each column of the search group in each frame.

Additional Considerations

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. A hardware module is tangible unit capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion embodied as executable instructions or code) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Some portions of this specification are presented in terms of algorithms or symbolic representations of operations on data stored as bits or binary digital signals within a machine memory (e.g., a computer memory). These algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or a combination thereof), registers, or other machine components that receive, store, transmit, or display information.

As used herein any reference to "one embodiment" or "an embodiment" means that a particular element, feature, structure, or characteristic described in connection with the embodiment is included in at least one embodiment. The phrase "in one embodiment" in various places in the specification is not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and method for performing charge sharing during a polarity period through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope described.

What is claimed is:

1. A method comprising:

receiving a first frame of display data comprising row data for a plurality of rows of a display region;

dividing the first frame into a plurality of search groups, each search group comprising a specified number of rows, less than all, from the plurality of rows;

for each respective search group in the plurality of search groups of the first frame:

identifying a first row from the specified number of rows included in the respective search group, wherein the first row includes one or more sub-pixels;

determining a gray level value for each of the one or more sub-pixels included in the first row;

applying a first chopper mode to each of the one or more sub-pixels included in the first row;

identifying a second row, distinct from the first row, from the specified number of rows included in the respective search group, wherein the second row includes one or more corresponding sub-pixels;

determining a gray level value for each of the one or more corresponding sub-pixels included in the second row;

comparing the determined gray level value for each of the one or more sub-pixels included in the first row with the determined gray level value for each of the one or more corresponding sub-pixels included in the second row; and applying a second chopper mode to the one or more corresponding sub-pixels included in the second row when the comparing indicates that the determined gray level value for each of the one or more sub-pixels included in the first row matches the determined gray level value for each of the one or more corresponding sub-pixels included in the second row.

2. The method of claim 1, further comprising:

applying a chopper mode control signal having a first state to one or more output buffers coupled to the one or more sub-pixels included in the first row during a first time; and applying the chopper mode control signal having a second state to the one or more output buffers coupled to the one or more corresponding sub-pixels included in the second row during a second time.

3. The method of claim 1, wherein the first row and the second row of the respective search group are adjacent rows included in the respective search group.

4. The method of claim 1, further comprising:

applying the first chopper mode to the one or more corresponding sub-pixels included in the second row when the comparing indicates that the determined gray level value for each of the one or more sub-pixels included in the first row do not match the determined gray level value for each of the one or more corresponding sub-pixels included in the second row of the respective search group.

5. The method of claim 4, further comprising, for each respective search group in the plurality of search groups of the first frame:

identifying a third row, distinct from the first and second rows, from the specified number of rows included in the respective search group, wherein the third row includes one or more corresponding sub-pixels;

determining a gray level value for each of the one or more corresponding sub-pixels included in the third row of the respective search group;

comparing the determined gray level value for each of the one or more sub-pixels included in the first row with the determined gray level value for each of the one or more corresponding sub-pixels included in the third row; and applying a second chopper mode to the one or more corresponding sub-pixels included in the third row when the comparing indicates that the determined gray level value for each of the one or more sub-pixels included in the first row matches the determined gray level value for each of the one or more corresponding sub-pixels included in the third row of the respective search group.

6. The method of claim 5, wherein the second row and the third row are adjacent rows.

7. A method comprising:

receiving a first frame of display data comprising row data for a plurality of rows and a plurality of columns of a display region;

dividing the first frame into a plurality of search groups, each search group comprising a specified number of rows, less than all, from the plurality of rows;

for each respective search group in the plurality of search groups of the first frame:

identifying a first row from the specified number of rows included in the respective search group, wherein the first row includes one or more sub-pixels;

for each column of the plurality of columns:

determining a gray level value for a first sub-pixel of the one or more sub-pixels included in the first row;

applying a first chopper mode to the first sub-pixel included in the first row;

identifying a second row, distinct from the first row, from the specified number of rows included in the respective search group, wherein the second row includes one or more corresponding sub-pixels;

determining a gray level value for a second sub-pixel of the one or more corresponding sub-pixels included in the second row of the respective search group;

comparing the gray level value of the first sub-pixel with the gray level value of the second sub-pixel; and applying a second chopper mode to the second sub-pixel when the comparing indicates the gray level value of the first sub-pixel matches the gray level value of the second sub-pixel.

8. The method of claim 7, further comprising:

applying a chopper mode control signal having a first state an output buffer coupled to the first sub-pixel included in the first row during a first time; and applying the chopper mode control signal having a second state to the output buffer coupled to the second sub-pixel included in the second row of the during a second time.

9. The method of claim 7, wherein the first row and the second row of the respective search group are adjacent rows included in the respective search group.

10. The method of claim 7, further comprising:

for each respective search group in the plurality of search groups and for each column of the plurality of columns:

applying the first chopper mode to the second sub-pixel when the comparing indicates that the determined gray level value for the first sub-pixel does not match the determined gray level value the second sub-pixel.

11. The method of claim 10, further comprising, for each respective search group in the plurality of search groups of the first frame:

identifying a third row, distinct from the first and second rows, from the specified number of rows included in the respective search group, wherein the third row includes one or more corresponding sub-pixels;

determining a gray level value for a third sub-pixel of the one or more corresponding sub-pixels included in the third row of the respective search group, where the third row is distinct from the first and second rows;

comparing the gray level value of the first sub-pixel with the gray level value of the third sub-pixel; and applying the second chopper mode to the third sub-pixel when the comparing indicates that the gray level value of the first sub-pixel matches the gray level value of the third sub-pixel.

12. The method of claim 11, wherein the second row and the third row are adjacent rows.

13. A method comprising:

receiving a first frame of display data comprising row data for a plurality of rows and a plurality of columns of a display region;

dividing the first frame into a plurality of search groups, each search group comprising a specified number of rows, less than all, from the plurality of rows;

for each respective search group in the plurality of search groups of the first frame:

identifying a first row from the specified number of rows included in the respective search group, wherein the first row includes one or more sub-pixels;

for each column of the plurality of columns:

determining a gray level value for a first sub-pixel of the one or more sub-pixels included in the first row;

applying a first chopper mode to the first sub-pixel included in the first row;

identifying a second row, distinct from the first row, from the specified number of rows included in the respective search group, wherein the second row includes one or more corresponding sub-pixels;

determining a gray level value for a second sub-pixel of the one or more corresponding sub-pixels included in the second row of the respective search group;

comparing the gray level value of the first sub-pixel with the gray level value of the second sub-pixel; and comparing the gray level value of the second sub-pixel with the gray level value of the first sub-pixel;

applying the first chopper mode to the second sub-pixel when the comparing indicates that the gray level value of the second sub-pixel is different that the gray level value of the first sub-pixel;

identifying a third row, distinct from the first and second rows, from the specified number of rows included in the respective search group, wherein the third row includes one or more corresponding sub-pixels;

comparing the gray level value of a third sub-pixel of the one or more corresponding sub-pixels included in the third row of the respective search group with the gray level value of the second sub-pixel and the gray level value of the first sub-pixel; and when the comparing indicates that the gray level value of the third sub-pixel matches the gray level value of the first sub-pixel, applying a second chopper mode to the third sub-pixel, the second copper mode being different from the first chopper mode applied to the first sub-pixel.

14. The method of claim 13, wherein the first sub-pixel and the second sub-pixel are located in adjacent rows in the respective search group.

15. The method of claim 13, further comprising:

for each respective search group in the plurality of search groups and for each column of the plurality of columns:

applying the second chopper mode to the second sub-pixel when the comparing indicates that the gray level value of the first sub-pixel matches the gray level value of the second sub-pixel.

16. The method of claim 15, further comprising:

applying a chopper mode control signal having a first state to an output buffer coupled to the first sub-pixel at a first time; and applying the chopper mode control signal having a second state to an output buffer coupled to the second sub-pixel at a second time.

17. The method of claim 16, further comprising:

applying a different chopper mode to the third sub-pixel relative to the chopper mode applied to the second sub-pixel when the comparing indicates the gray level value of the third sub-pixel matches the gray level value of the second sub-pixel.

18. The method of claim 17, further comprising, for each respective search group in the plurality of search groups of the first frame:

identifying a fourth row, distinct from the first, second, and third rows, from the specified number of rows included in the respective search group, wherein the fourth row includes one or more corresponding sub-pixels;

determining a gray level value for a fourth sub-pixel of the one or more corresponding sub-pixel included in the fourth row of the respective search group;

comparing the gray level value of the fourth sub-pixel with each of the gray level values of the first, second, and third sub-pixels; and applying a different chopper mode to the fourth sub-pixel relative to the chopper mode applied to the third sub-pixel when the comparing indicates the gray level value of the fourth sub-pixel matches the gray level of the third sub-pixel.

19. The method of claim 18, wherein the third row and the fourth row are adjacent rows within the respective search group.

20. The method of claim 18, wherein the second row, the third row, and the fourth row are adjacent rows within the respective search group.

* * * * *